US010587081B2

(12) United States Patent
Valenti et al.

(10) Patent No.: US 10,587,081 B2
(45) Date of Patent: Mar. 10, 2020

(54) COMMUNICATION CONNECTORS AND COMPONENTS THEREOF

(71) Applicant: Panduit Corp., Tinley Park, IL (US)

(72) Inventors: Joshua A. Valenti, Ferndale, MI (US); Sean W. Lenz, Countryside, IL (US); Andrew Ciezak, Georgetown, TX (US); Paul W. Wachtel, Arlington Heights, IL (US); Robert E. Fransen, Orland Park, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/913,059

(22) Filed: Mar. 6, 2018

(65) Prior Publication Data

US 2018/0269638 A1 Sep. 20, 2018

Related U.S. Application Data

(60) Provisional application No. 62/471,007, filed on Mar. 14, 2017.

(51) Int. Cl.

| | |
|---|---|
| ***H01R 4/24*** | (2018.01) |
| ***H01R 4/26*** | (2006.01) |
| ***H01R 11/20*** | (2006.01) |
| ***H01R 24/64*** | (2011.01) |
| ***H01R 13/6594*** | (2011.01) |
| ***H01R 12/58*** | (2011.01) |
| *H01R 107/00* | (2006.01) |

(52) U.S. Cl.

CPC ..... *H01R 24/64* (2013.01); *H01R 12/585* (2013.01); *H01R 13/6594* (2013.01); *H01R 2107/00* (2013.01)

(58) Field of Classification Search

CPC .. H01R 24/64; H01R 12/585; H01R 13/6594; H01R 2107/00

USPC ..... 439/418, 344

See application file for complete search history.

(56) References Cited

U.S. PATENT DOCUMENTS

| | | | | |
|---|---|---|---|---|
| 5,921,818 A * | 7/1999 | Larsen | H01R 13/6477 | 439/344 |
| 6,056,568 A * | 5/2000 | Arnett | H01R 13/6466 | 200/51.06 |
| 7,204,722 B2 * | 4/2007 | Hashim | H05K 1/0228 | 439/344 |
| 7,320,624 B2 * | 1/2008 | Hashim | H01R 13/6469 | 439/344 |

(Continued)

*Primary Examiner* — Abdullah A Riyami
*Assistant Examiner* — Thang H Nguyen
(74) *Attorney, Agent, or Firm* — Christopher S. Clancy; James H. Williams; Peter S. Lee

(57) ABSTRACT

Various implementations of communications connectors are disclosed. In some implementations, a communications connector, such as a communications plug, may include a plug body and a termination sled positioned at least partially in the plug body. The termination sled may include a printed circuit board (PCB) having a front section, a rear section, and a connecting section connecting the front section and the rear section. In some implementations, a communications cord may include a communications plug having a conductive shell and PCB assembly. The PCB assembly may include a PCB, front and rear load bars, and a shielded divider.

7 Claims, 40 Drawing Sheets

(56) References Cited

U.S. PATENT DOCUMENTS

| | | | | |
|---|---|---|---|---|
| 7,335,066 | B2 * | 2/2008 | Carroll | H01R 4/2429 174/27 |
| 9,531,135 | B2 * | 12/2016 | Gatnau Navarro | H01R 13/665 |
| 2005/0059291 | A1 * | 3/2005 | Wood | H01R 13/6658 439/418 |
| 2006/0160407 | A1 * | 7/2006 | Carroll | H01R 13/6467 439/418 |
| 2009/0142968 | A1 * | 6/2009 | Goodrich | H01R 4/2412 439/676 |
| 2013/0072042 | A1 * | 3/2013 | Liao | H01R 13/447 439/142 |
| 2014/0342608 | A1 * | 11/2014 | Wu | H01R 13/6658 439/607.35 |
| 2016/0344139 | A1 * | 11/2016 | O'Young | H01R 13/6461 |
| 2017/0033503 | A1 * | 2/2017 | Oberski | H01R 12/515 |
| 2018/0269638 | A1 * | 9/2018 | Valenti | H01R 24/64 |

* cited by examiner

COMMUNICATION CONNECTORS AND COMPONENTS THEREOF

CROSS-REFERENCE TO RELATED APPLICATIONS

This application claims the benefits of priority to U.S. Provisional Application No. 62/471,007, filed on Mar. 14, 2017, the entirety of which is incorporated herein by reference.

BACKGROUND

In network connectivity, the RJ45 form factor has been widely adopted by many in the industry. This form factor allows for easy and effective mating of two communications cables or communications cables and communications equipment via a corresponding pair of an RJ45 plug and an RJ45 jack. While being effective at providing physical connectivity, signal problems can arise when RJ45 connectors are placed in close proximity to each other as a result of alien crosstalk. Alien crosstalk is an interference caused by conductors of one connector inducing electromagnetic noise into the conductors of another, adjacent connector.

BRIEF DESCRIPTION OF THE DRAWINGS

The following detailed references the drawings, wherein.

DETAILED DESCRIPTION

One way to address alien crosstalk is to provide shielded connectors which impede the ability of a connector to interfere with a neighboring connector. However, installations of such connectors, especially in the field, are difficult due to the number of components that must be assembled and/or the bulky tools that must be used for assembly. Moreover, since RJ45 connectivity is typically used with twisted pair cabling having multiple conductor pairs, crosstalk (intentional and unintentional) inside the connector between those pairs could be difficult to manage. The communications connectors described in the present disclosure address these issues and more.

Figure 1:
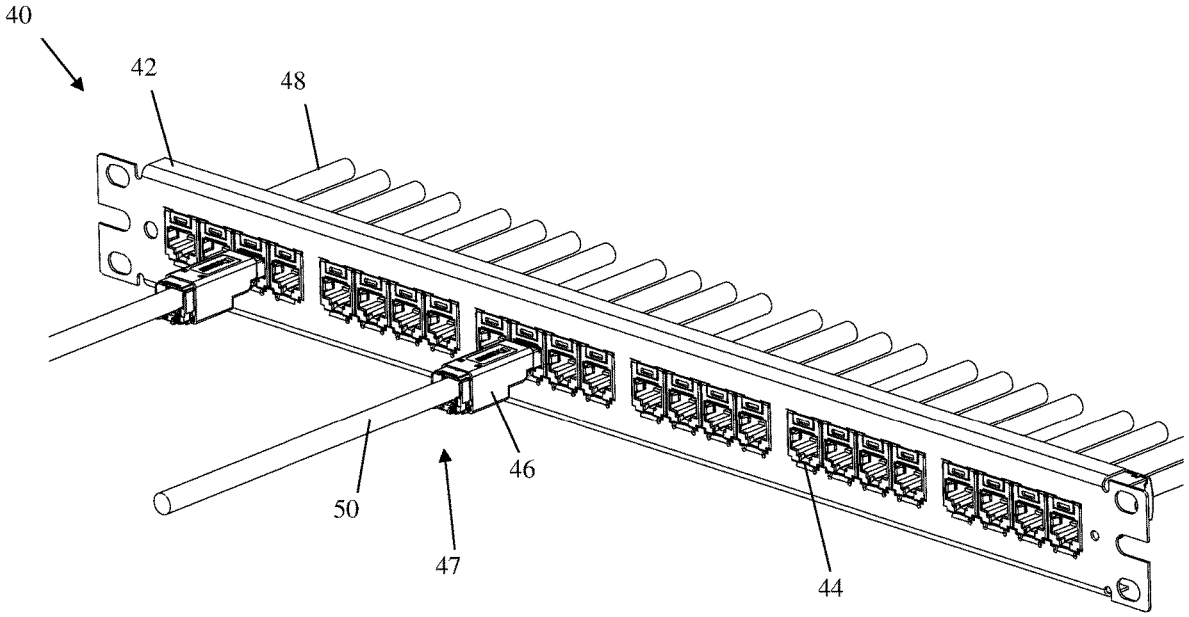
FIG. 1 is a perspective view of a communications system.

Referring to FIG. 1, according to an embodiment of the present disclosure, communications system 40 includes patch panel 42 with network jacks 44 and corresponding shielded communications plugs 46. Respective cables 48 are terminated with jacks 44 and respective cables 50 are terminated with plugs 46 forming respective cords 47. Once a shielded plug assembly 46 mates with a network jack 44, data can flow in both directions through these connectors. Although communications system 40 is illustrated as a patch panel in FIG. 1, it can alternatively be other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and/or telecommunications rooms, security devices (cameras and other sensors, etc.) and door access equipment, and telephones, computers, fax machines, printers and other peripherals as can be found in workstation areas. Communications system 40 can further include cabinets, racks, cable management and overhead routing systems, and other such equipment.

Embodiments of the present disclosure can be applied to and/or implemented in a variety of shielded communications cables, including any of CAT5E, CAT6, CAT6A, CAT7, CAT8 or other twisted pair Ethernet cables, as well as other types of cable. Shielded communications cord 47 can have its other end (not shown) terminated directly into equipment, or alternatively, can be terminated in a variety of plugs or jack modules such as RJ45 or other types, jack module cassettes, and many other connector types, or combinations thereof. Shielded communications cord 47 can be used in a variety of structured cabling applications, including patch cords, backbone cabling, and horizontal cabling, although the present disclosure is not limited to such applications. In general, embodiments of the present disclosure can be used in military, industrial, telecommunications, computer, data communications, marine and other applications.

Figure 2:
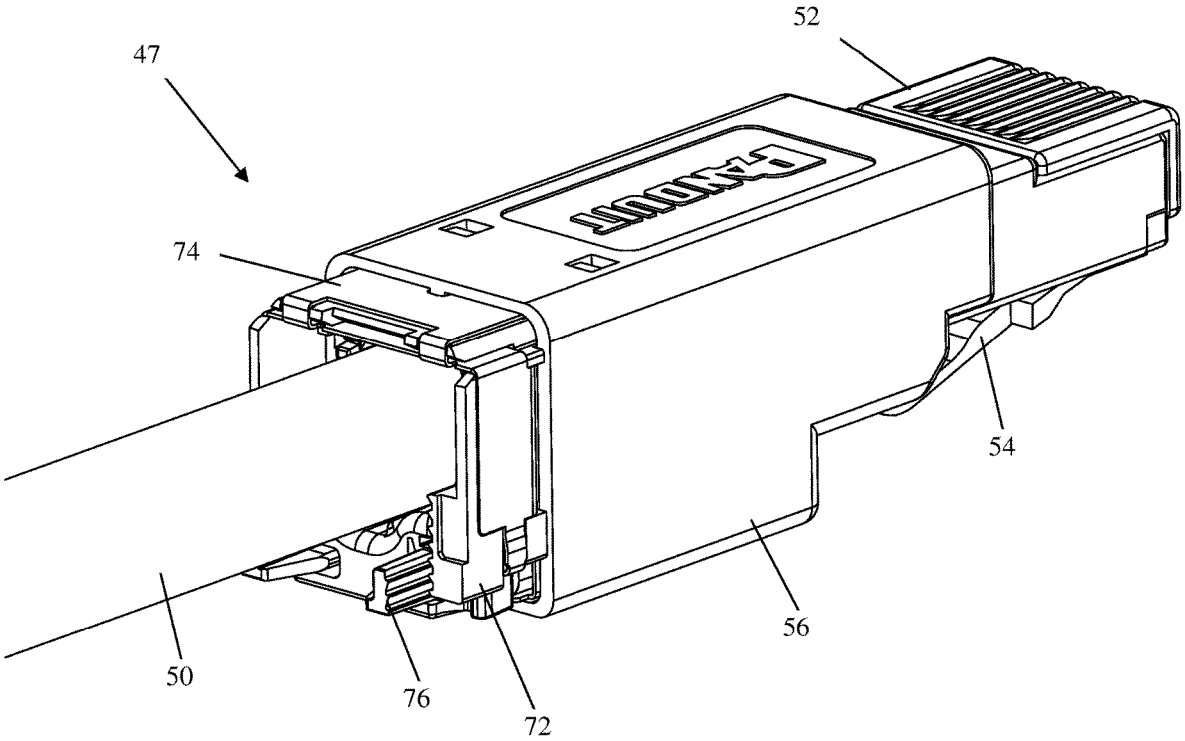
FIG. 2 is a top front isometric view of an implementation of a shielded communications cord, according to the present disclosure.
Figure 3:
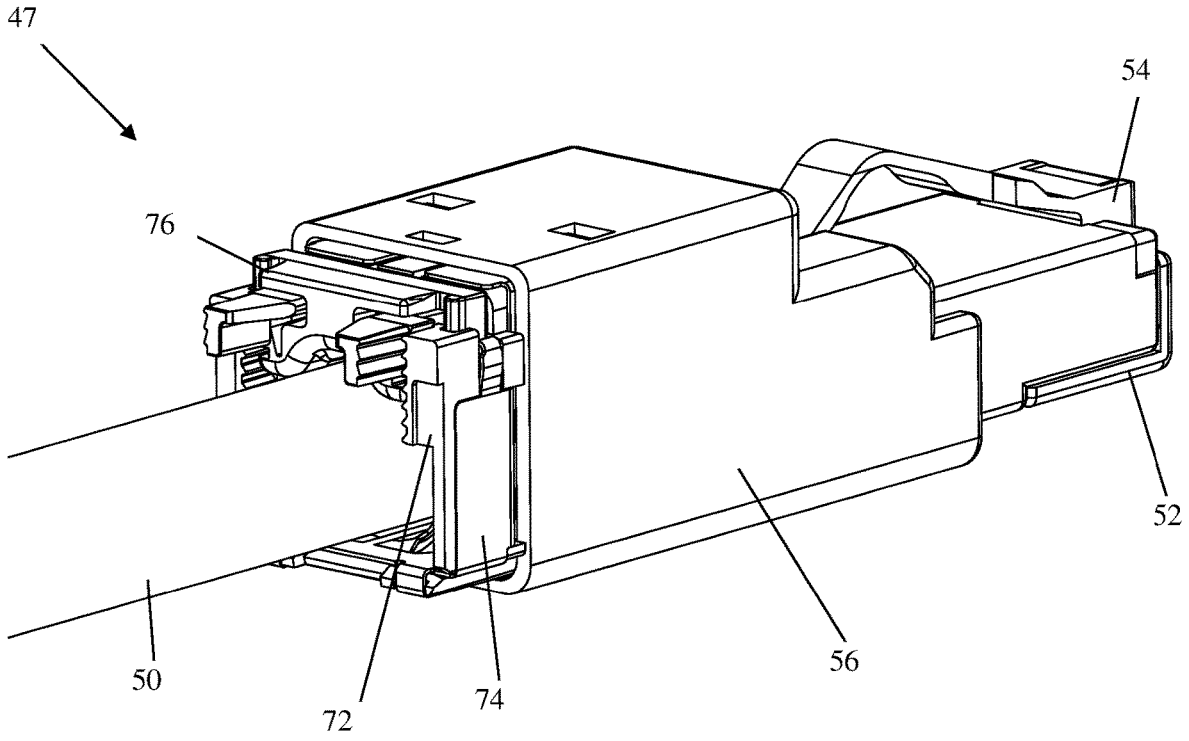
FIG. 3 is a bottom front isometric view of the shielded communications cord shown in FIG. 2.
Figure 4:
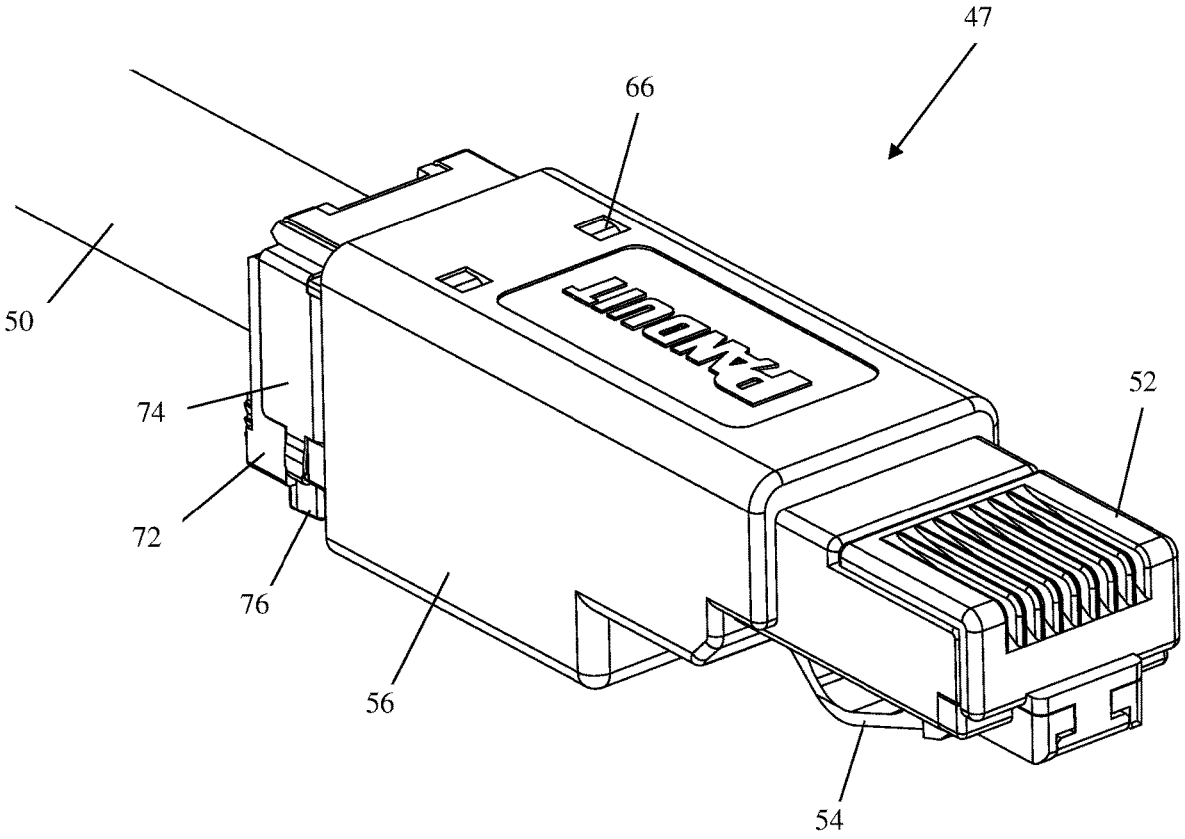
FIG. 4 is a rear isometric view of the shielded communications cord shown in FIG. 2.
Figure 5:
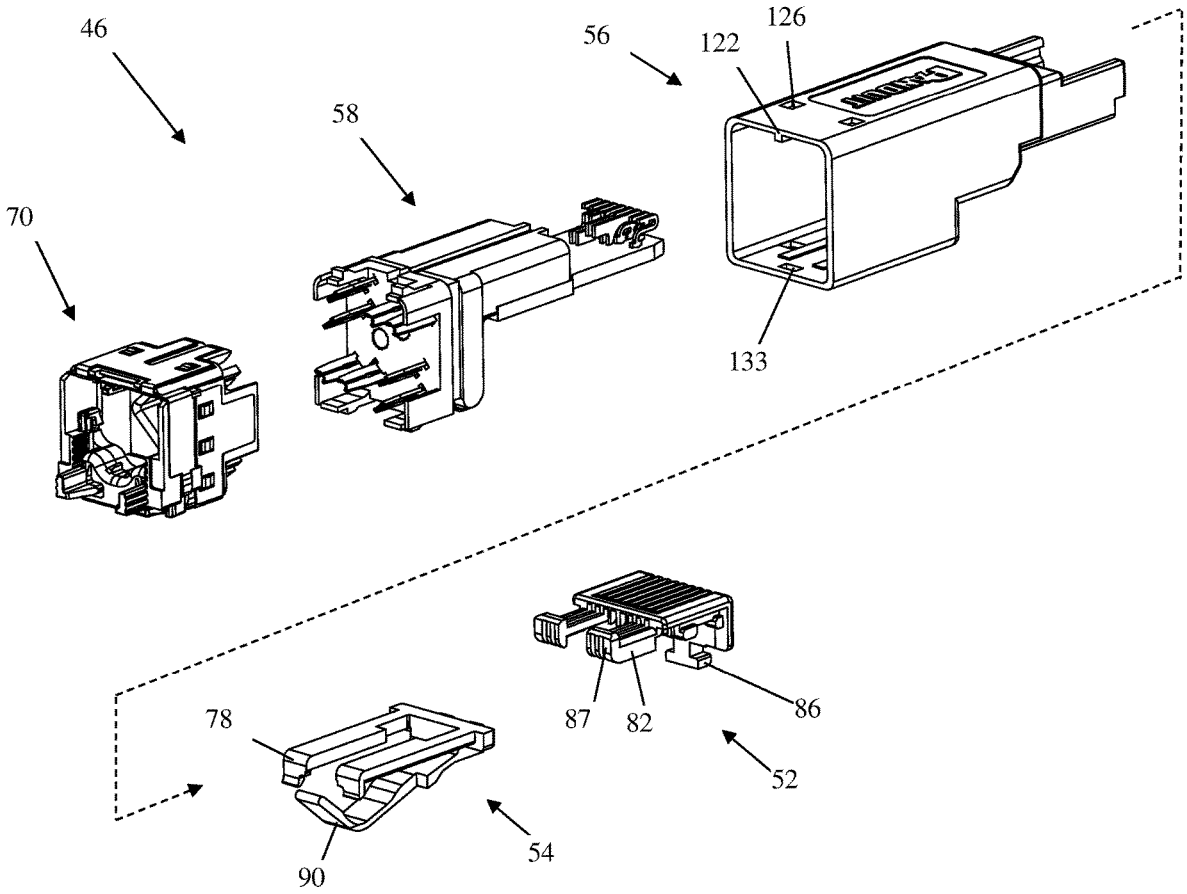
FIG. 5 is an exploded front top isometric view of a shielded plug assembly of the shielded communications cord shown in FIG. 2.
Figure 6:
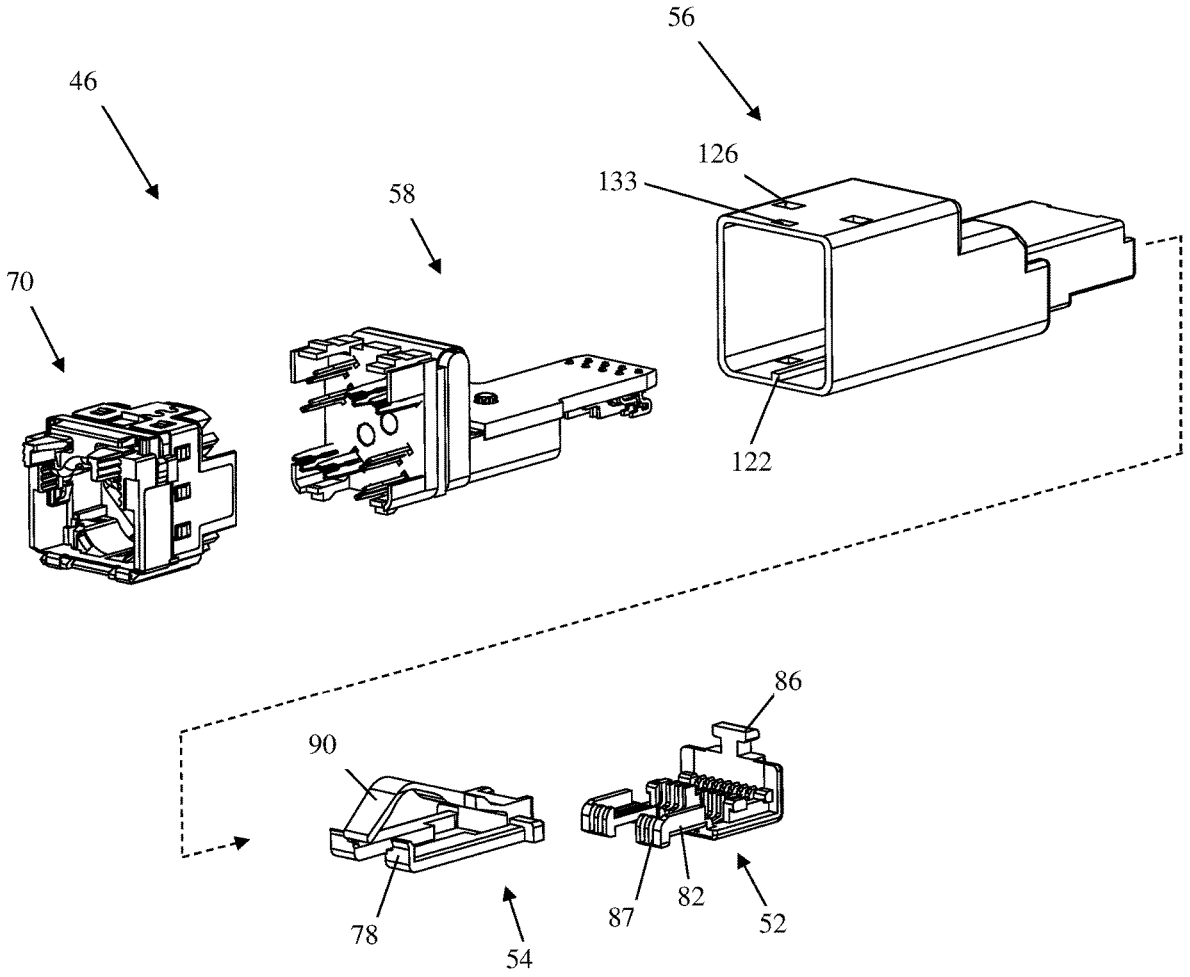
FIG. 6, an exploded front bottom isometric view of the shielded plug assembly shown in FIG. 5.
Figure 7:
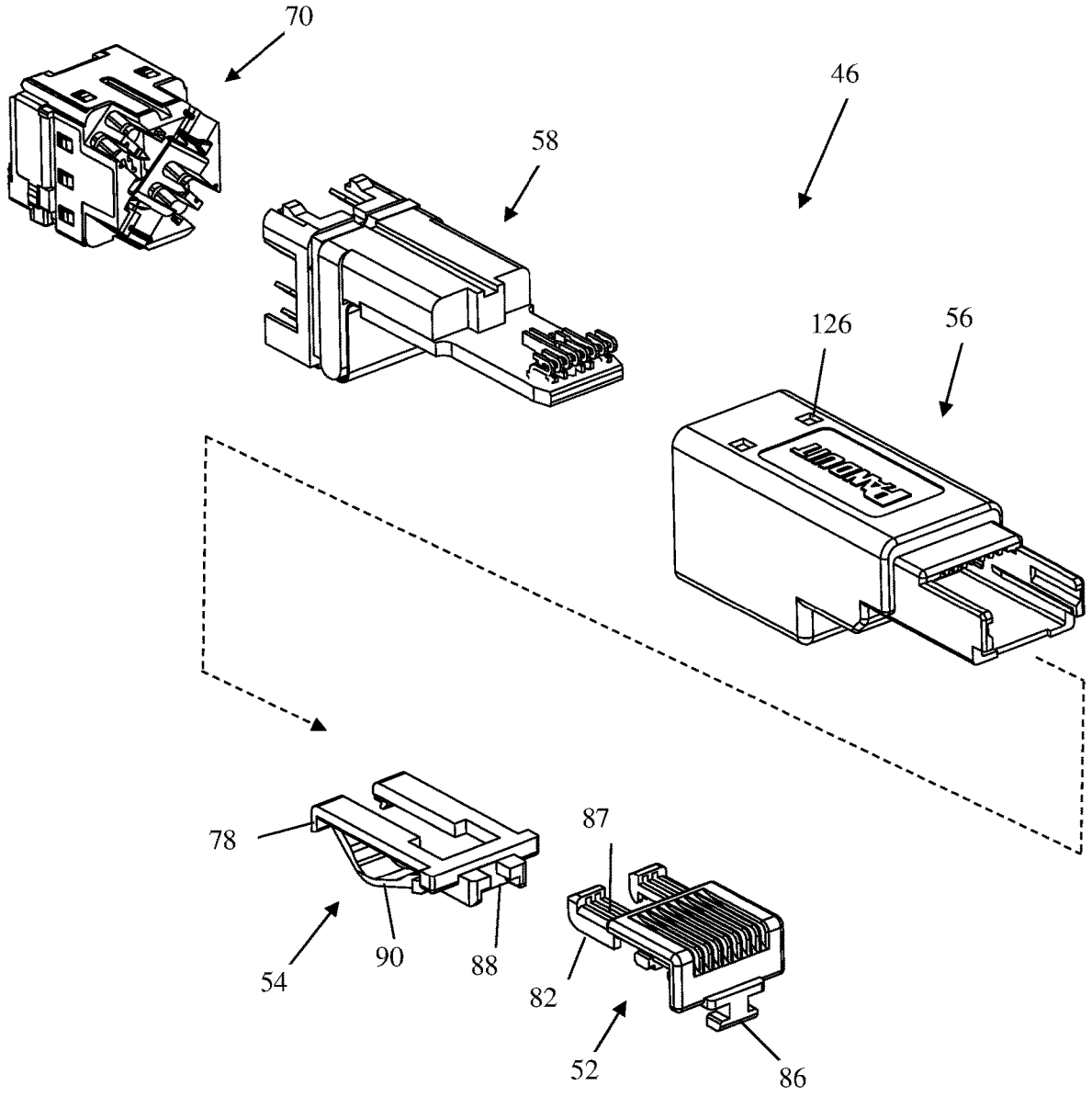
FIG. 7 is an exploded rear isometric view of the shielded plug assembly shown in FIG. 5.

FIG. 2 is a top front isometric view of shielded communications cord 47. FIG. 3 is a bottom front isometric view of the shielded communications cord 47. FIG. 4 is a rear isometric view of shielded communications cord 47. FIG. 5 is an exploded front top isometric view of shielded plug assembly 46. Shielded plug assembly 46 includes front nose 52, front latching component 54, conductive plug body 56, termination sled 58 (which includes rigid flex PCB 60, plug contacts 62, front sled 64, rear sled 66, and insulation displacement contacts (IDCs) 68), and wire cap assembly 70 (which includes termination cap 72, wire cap shield 74, and conductive strain relief clip 76). Referring to FIG. 6, an exploded front bottom isometric view of shielded plug assembly 46 is shown. FIG. 7 is an exploded rear isometric view of shielded plug assembly 46.

Figure 8:
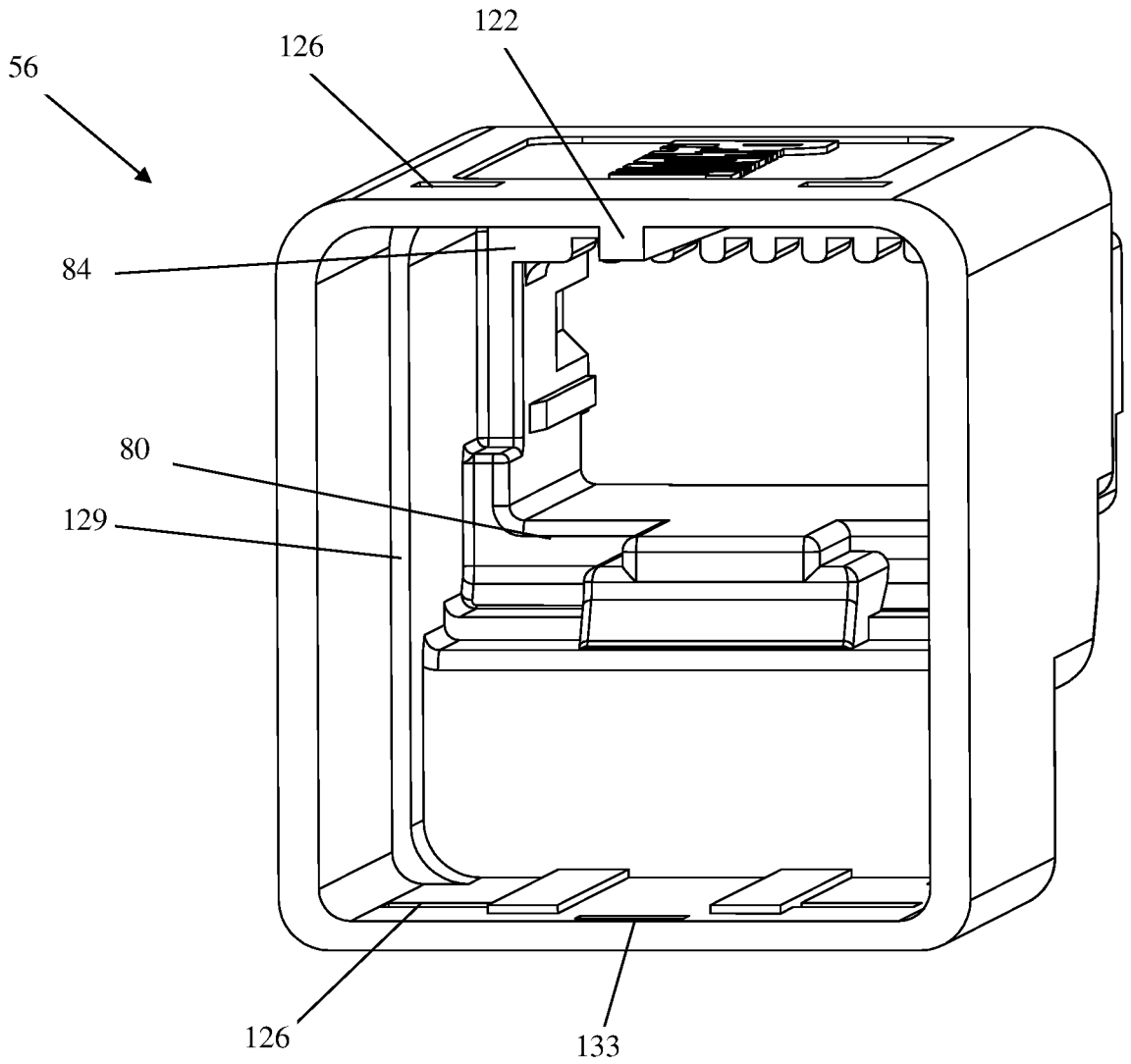
FIG. 8 is a rear trimetric view of a conductive plug body included in the shielded plug assembly shown in FIG. 5.
Figure 9:
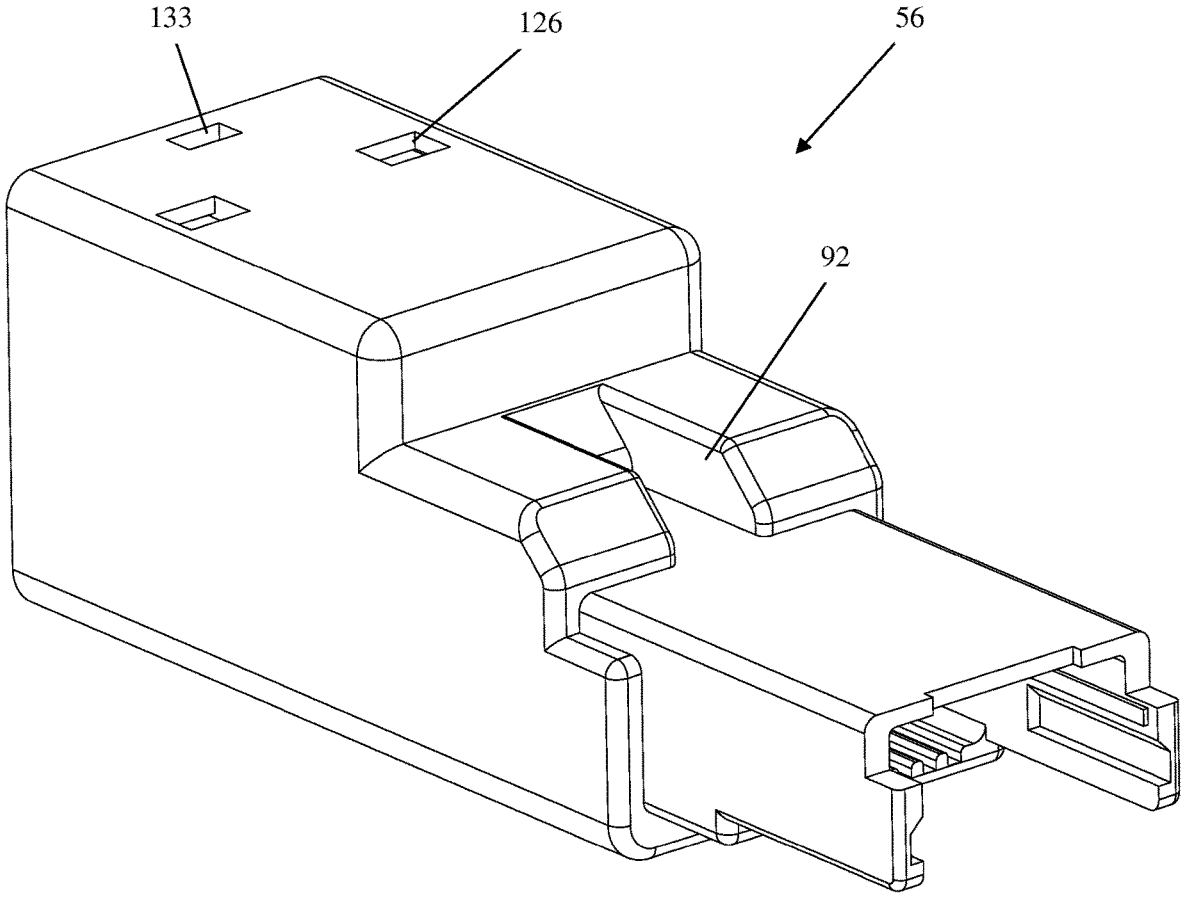
FIG. 9 is a front trimetric view of the conductive plug body shown in FIG. 8.

FIG. 8 is a rear trimetric view of conductive plug body 56. FIG. 9 is a front trimetric view of conductive plug body 56. During assembly, retention arms 78 of front latching component 54 engage with bottom rear ledge 80 of conductive plug body 56 to secure the two components together. Retention legs 82 of front nose 52 engage with top rear ledge 84 of conductive plug body 56 to secure the two components together. Front alignment feature 86 of front nose 52 aligns with front alignment slot 88 of front latching component 54. Clearance slots 87 of retention legs 82 provide for clearance of plug contacts 62 when termination sled 58 is inserted into conductive plug body 56. Tangle-free plug latch 90 of front latching component 54 is further protected from damage by plug latch slot 92 of conductive plug body 56.

Figure 10:
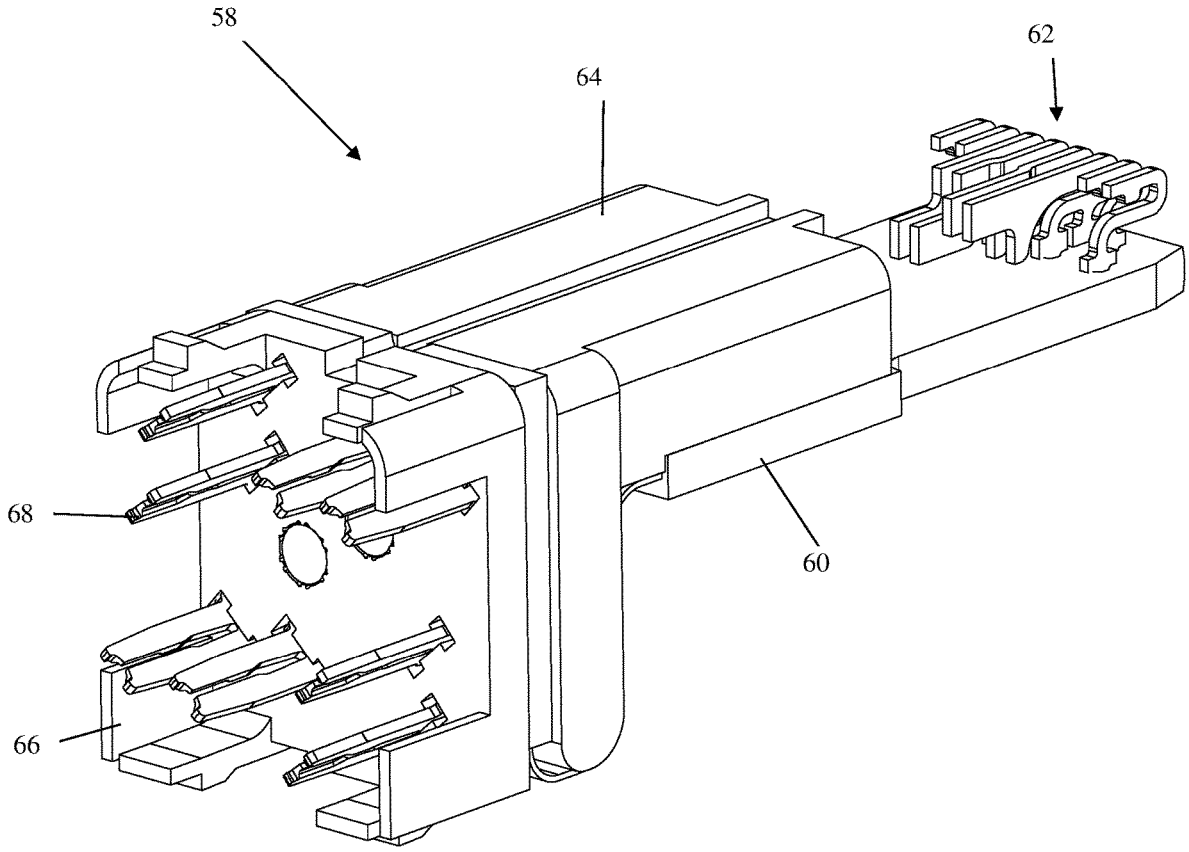
FIG. 10 is a top front isometric view of a termination sled included in the shielded plug assembly shown in FIG. 5.
Figure 11:
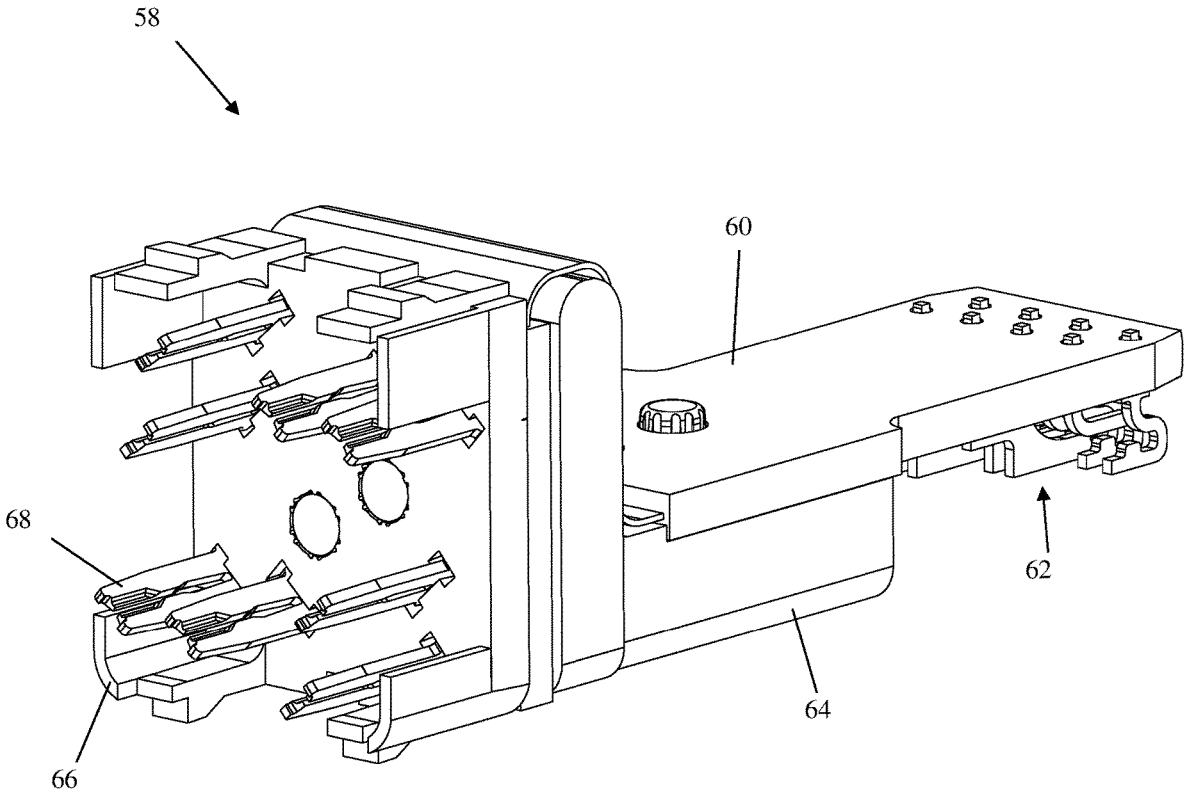
FIG. 11 is a bottom front isometric view of the termination sled shown in FIG. 10.
Figure 12:
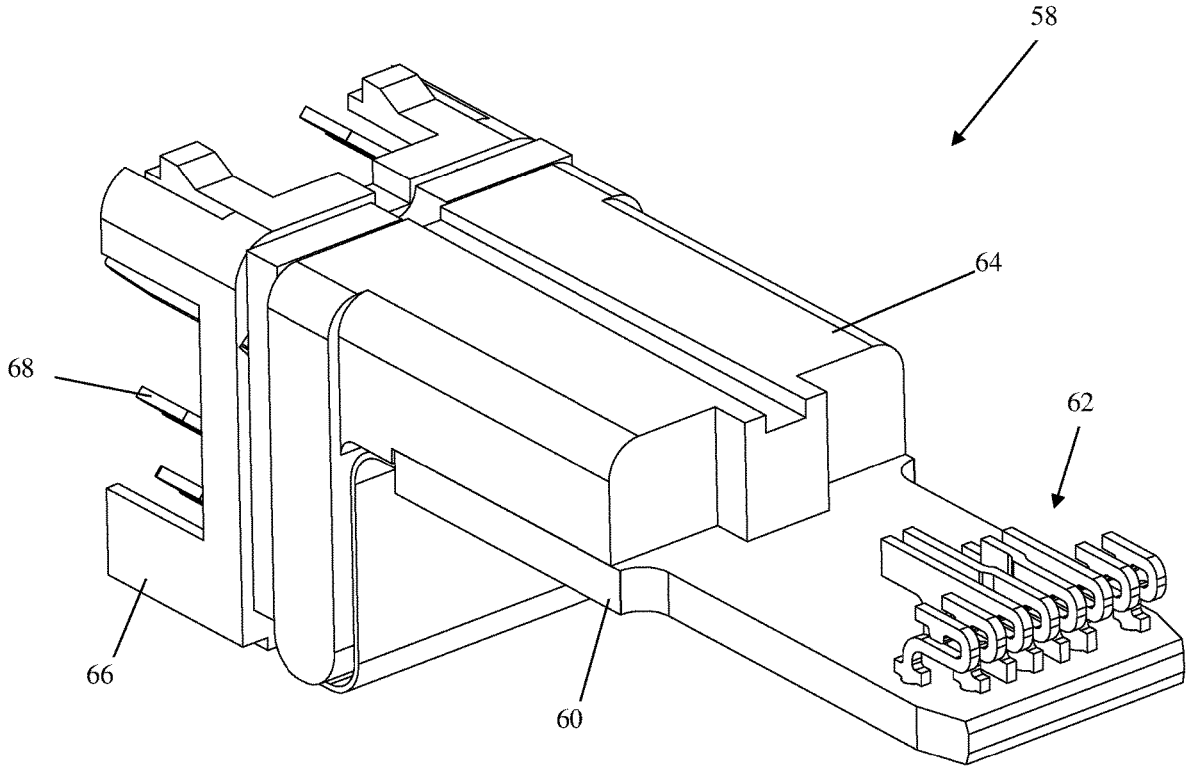
FIG. 12 is a rear isometric view of the termination sled shown in FIG. 10.
Figure 13:
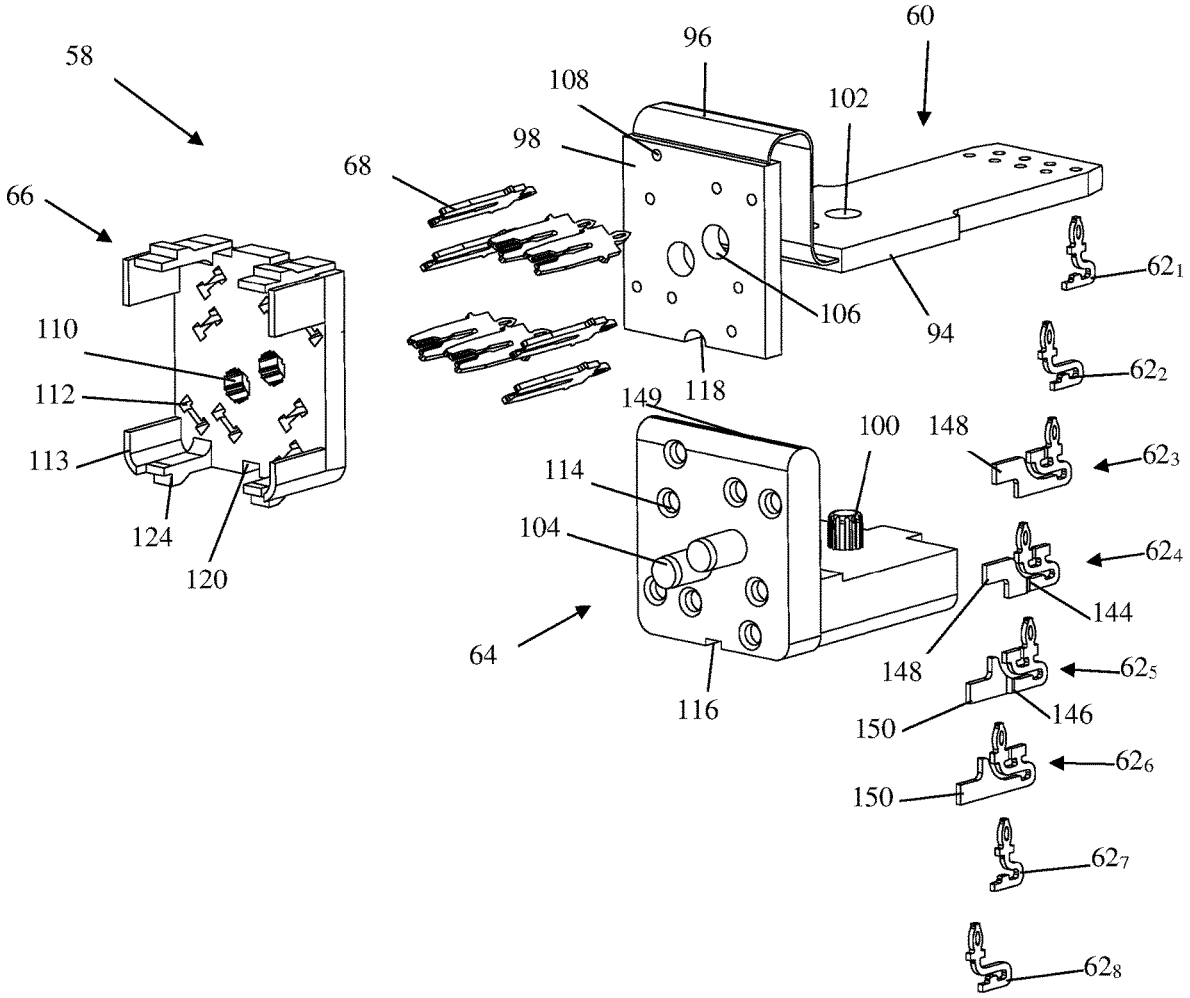
FIG. 13 is an exploded bottom front isometric view of the termination sled shown in FIG. 10.
Figure 14:
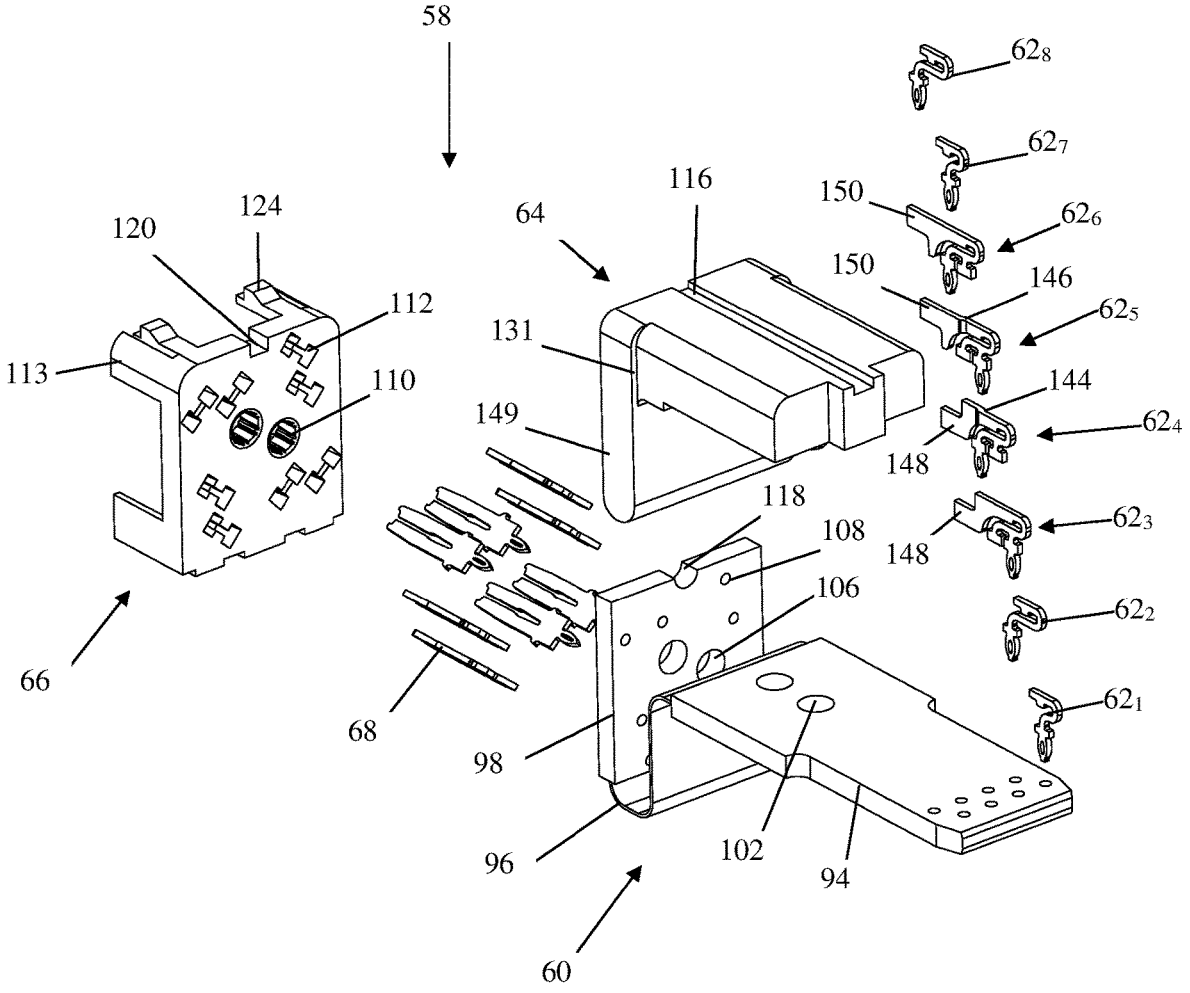
FIG. 14 is an exploded rear isometric view of the termination sled shown in FIG. 10.

FIG. 10 is a top front isometric view of termination sled 58. FIG. 11 is a bottom front isometric view of termination sled 58. FIG. 12 is a rear isometric view of termination sled 58. FIG. 13 is an exploded bottom front isometric view of termination sled 58. FIG. 14 is an exploded rear isometric view of termination sled 58. Rigid flex PCB 60, is shown as including three sections; front rigid section 94, middle flex section 96, and rear rigid section 98. Any or all of the rigid sections may be replaced by flexible sections, as the only section that is not linear in nature is middle flex section 96. However, in some instances the addition of rigid sections is beneficial. For instance, the majority of the electrical compensation network circuitry can be implemented in front rigid section 94 as close to the plug/jack mating interface and plug contacts 62 as possible, so sections in the middle and the rear can include impedance matching circuitry. Also, in the areas where there is a rigid section, more layers within the PCB are feasible. Moreover, both plug contacts 62 and IDCs 68 are shown as utilizing a compliant pin termination to rigid flex PCB 60, and such termination would be at least difficult if those circuit board sections were flexible. In that case, a soldered connection would be required, which can increase the cost of assembly.

Rigid flex PCB 60 is disclosed as a rigid-flex PCB, which typically has circuitry on the rigid layers of the PCB. This design could also be a multilayer circuit board with stiffeners that use no circuitry on the outer layers of the PCB. Alignment posts 100 of front sled 64 line up with alignment holes 102, in front rigid section 94 of rigid flex PCB 60. Alignment posts 104 of front sled 64 line up with alignment holes 106, in rear rigid section 98 of rigid flex PCB 60. IDCs 68 are secured to rear rigid section 98 of rigid flex PCB 60, at vias 108. Holes 110 of rear sled 66 also align with alignment posts 104 of front sled 64 which traps rigid flex PCB 60 in the assembly. IDC slots 112 of rear sled 66 provide clearance for IDCs 68 during assembly. Insulation posts 113 of rear sled 66, ensure that cable 50 does not short to conductive plug body 56 during final assembly.

Clear-outs 114 on front sled 64 provide clearance for any portion of IDC 68 that protrudes through via 108. Guidance slot 116 of front sled 64, guidance hole 118 of rigid flex PCB 60, and guidance notch 120 of rear sled 66, align with guide rail 122 of conductive plug body 56 during assembly. Latches 124 of rear sled 66 align with respective pockets 126 of conductive plug body to secure the overall termination sled 58. Stop face 129 of conductive plug body 56, coincides with stop face 131 of front sled 64.

As shown, for example, in FIGS. 13 and 14, middle flex section 96 of rigid-flex PCB 60 can be shaped around a vertical mandrel 149 on front sled 64 when rigid-flex 60 and front sled 64 are assembled together in termination sled 58. Mandrel 149 may be orientated perpendicular relative to a longitudinal direction of plug body 56. As a result, middle flex section 96 has an upside-down U shape when formed around mandrel 149.

Figure 15:
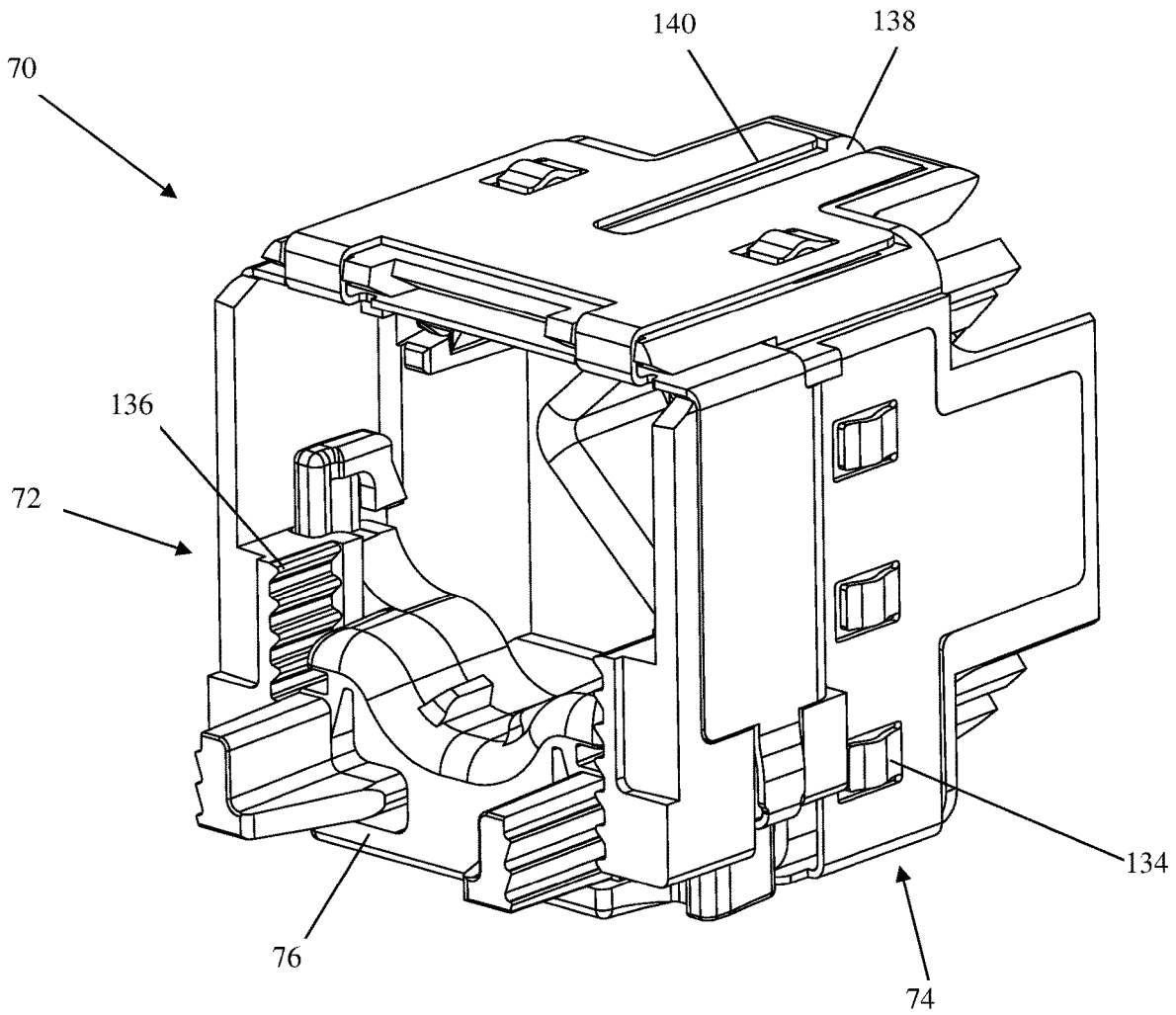
FIG. 15 is a top front isometric view of a wire cap assembly included in the shielded plug assembly included in FIG. 5.
Figure 16:
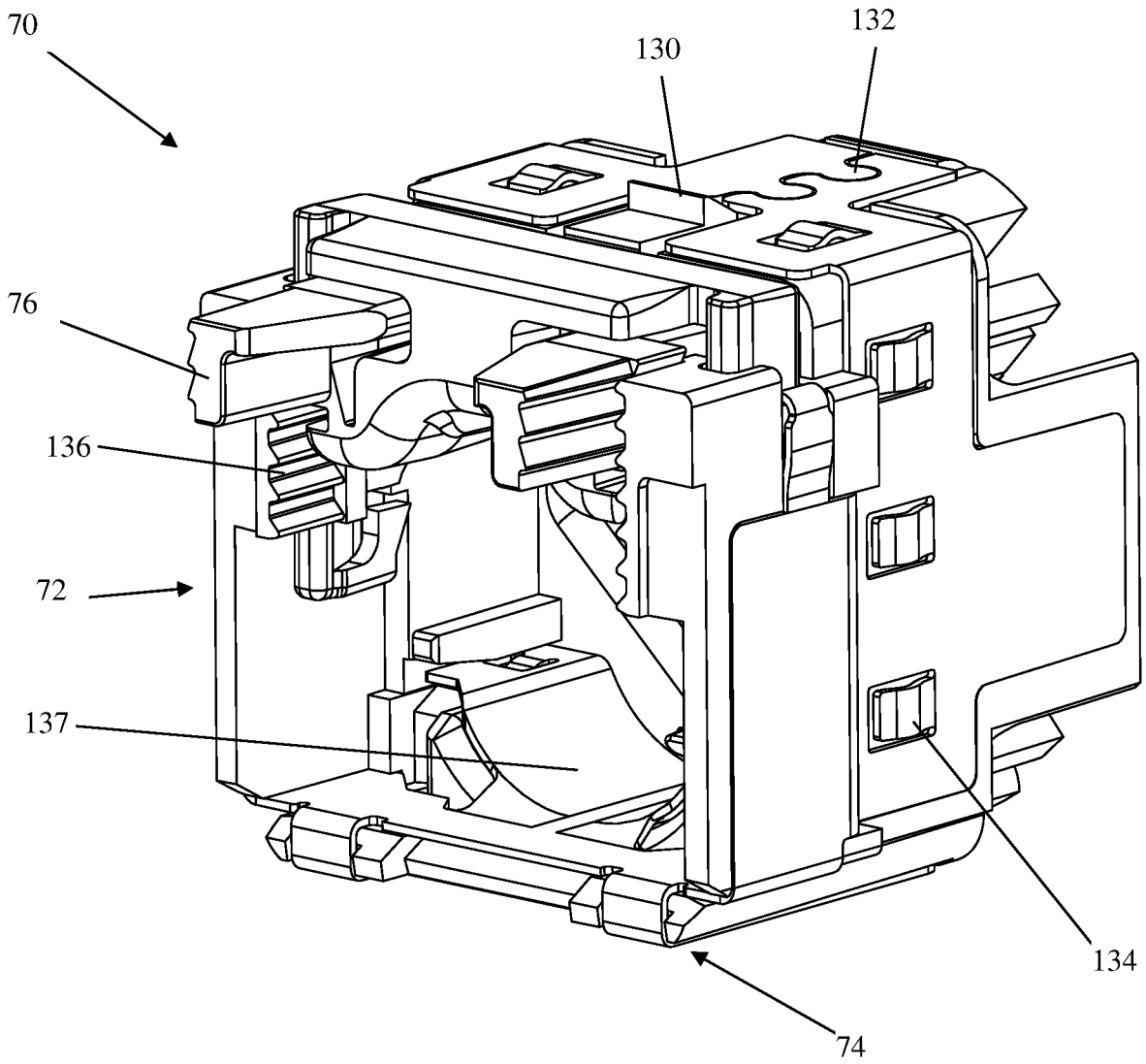
FIG. 16 is a bottom front isometric view of the wire cap assembly shown in FIG. 15.
Figure 17:
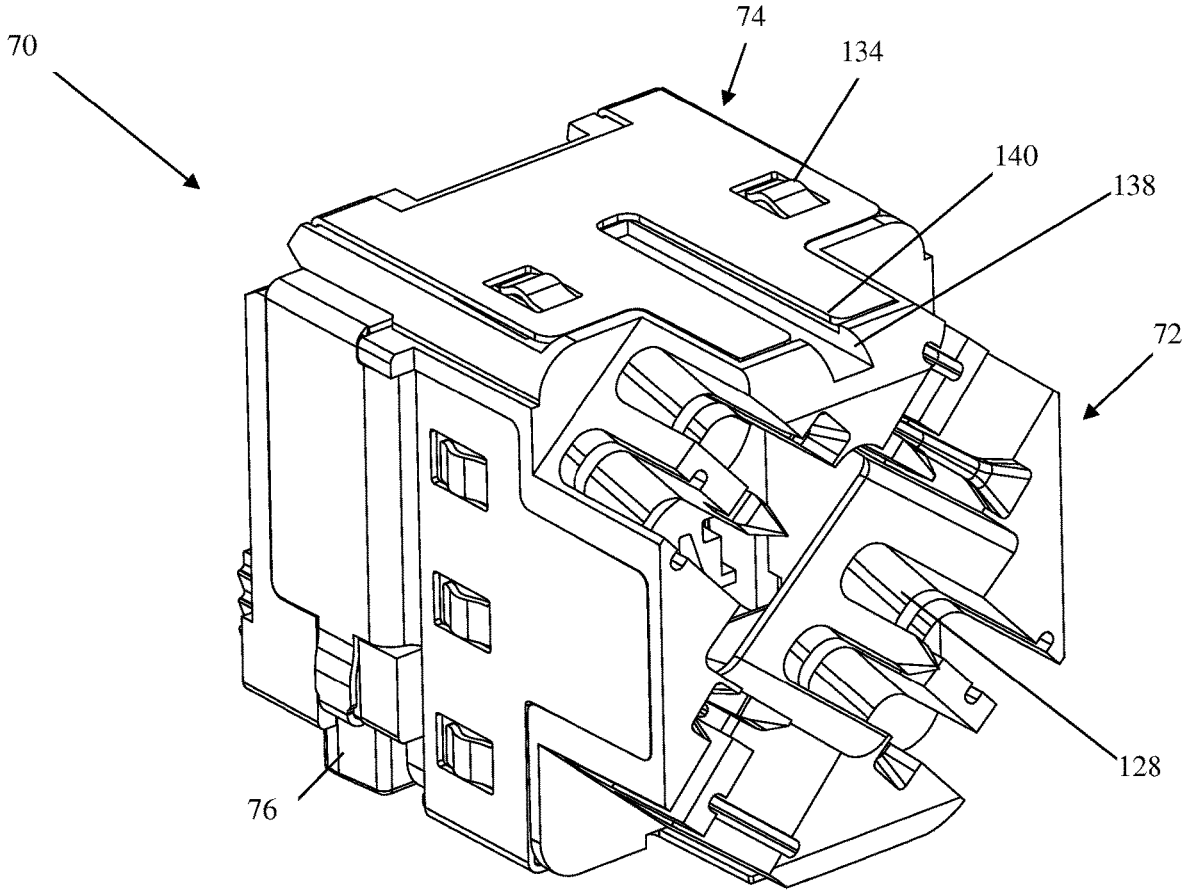
FIG. 17 is a rear isometric view of the wire cap assembly shown in FIG. 15.
Figure 18:
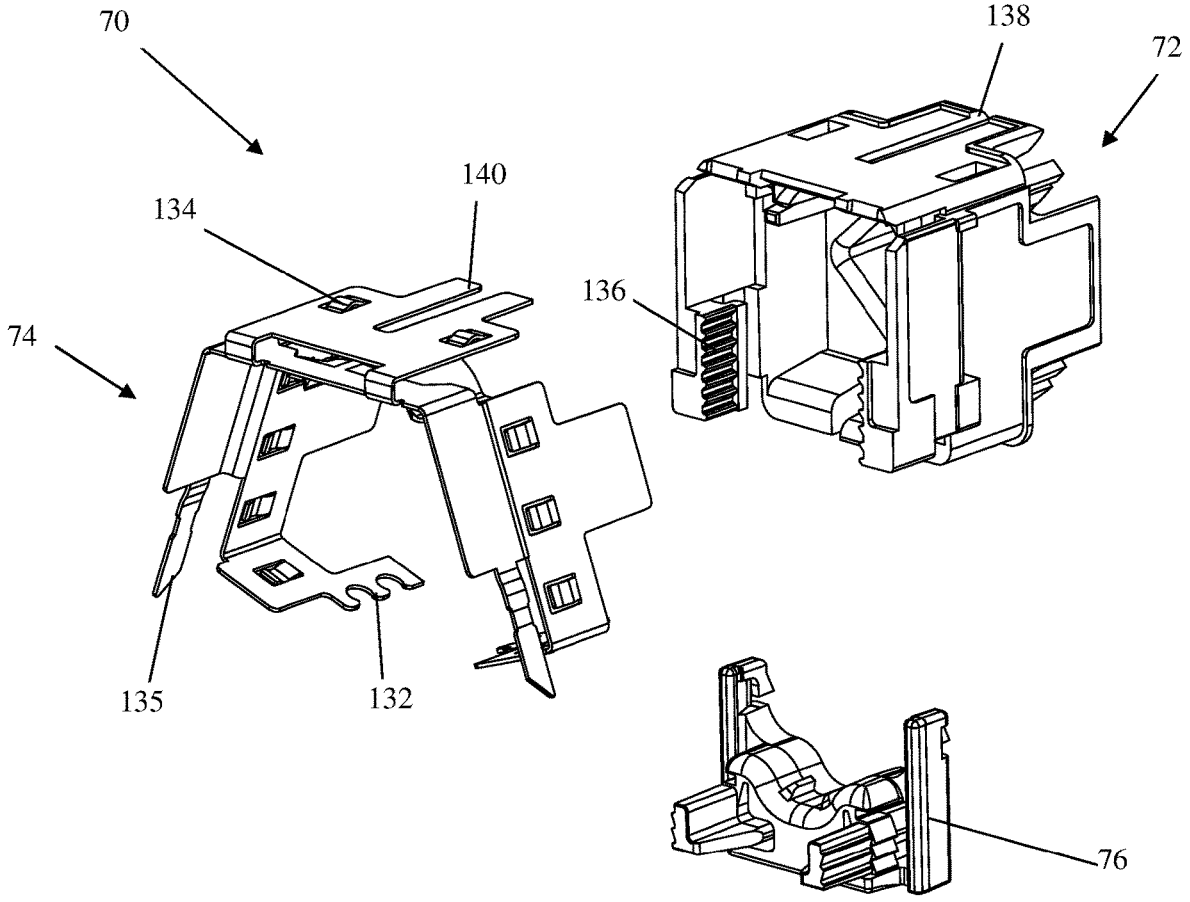
FIG. 18 is an exploded top front isometric view of the wire cap assembly shown in FIG. 15.
Figure 19:
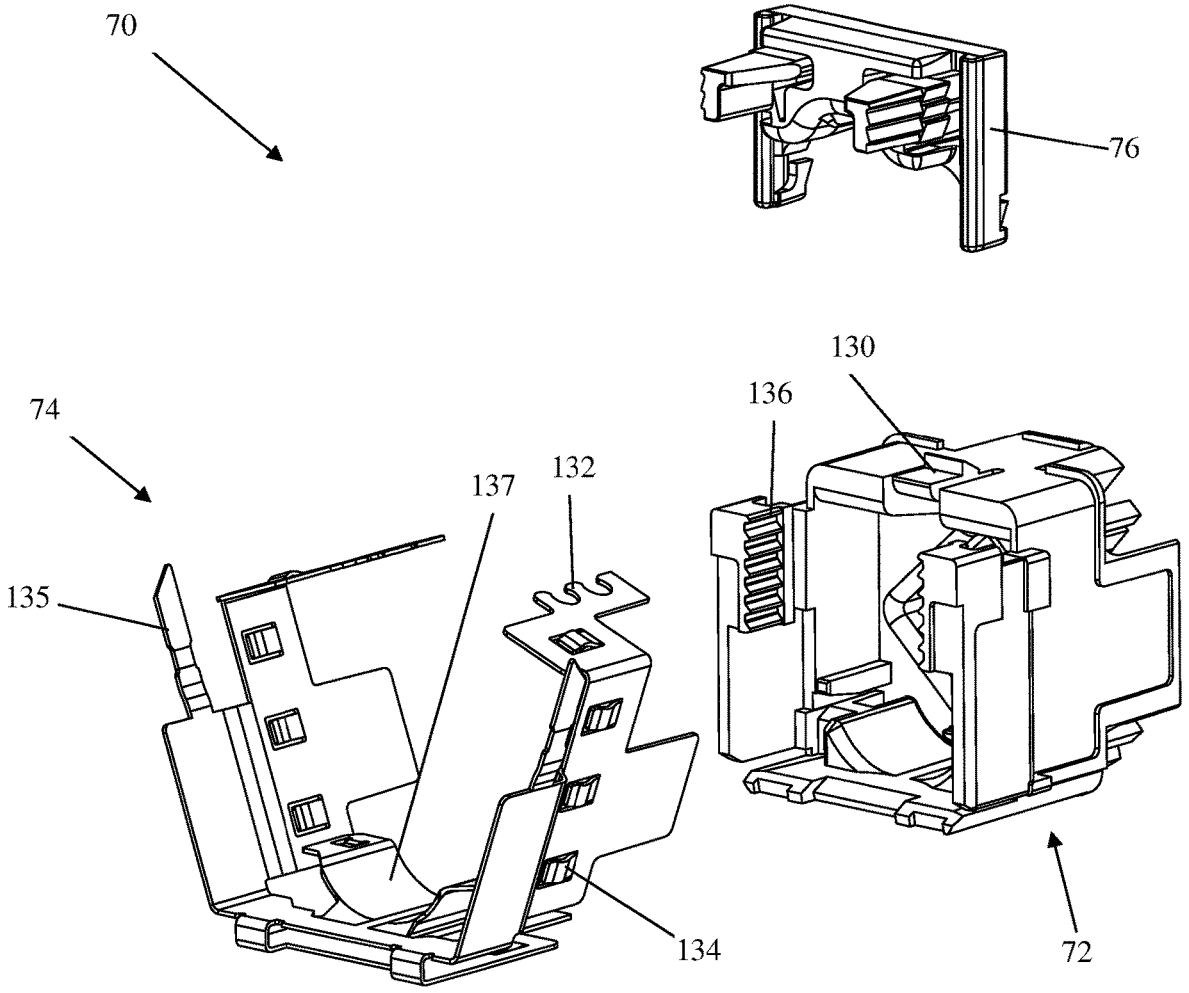
FIG. 19 is an exploded bottom front isometric view of the wire cap assembly shown in FIG. 15.
Figure 20:
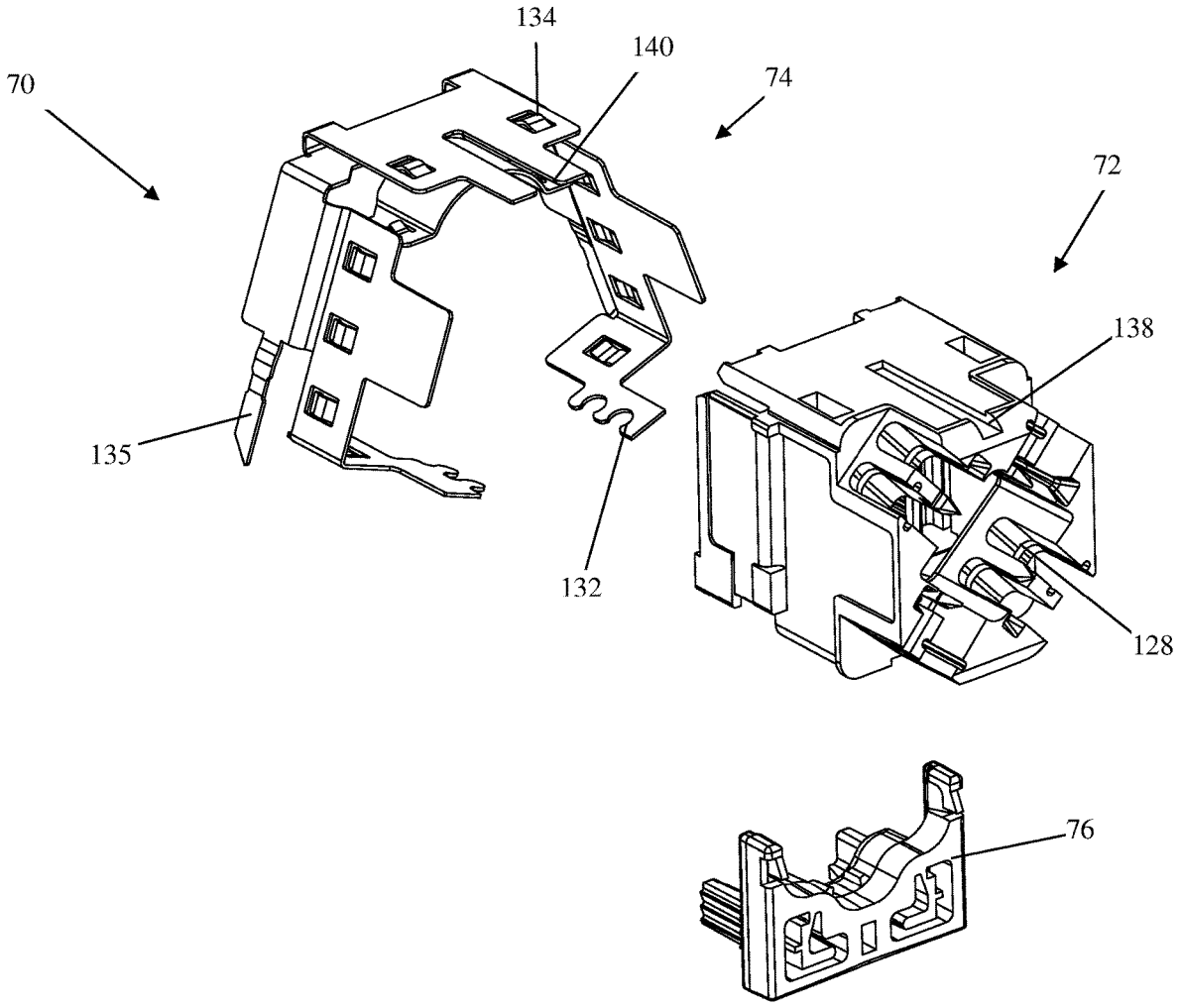
FIG. 20 is an exploded rear isometric view of the wire cap assembly shown in FIG. 15.

FIG. 15 is a top front isometric view of wire cap assembly 70. FIG. 16 is a bottom front isometric view of wire cap assembly 70. FIG. 17 is a rear isometric view of wire cap assembly 70. FIG. 18 is an exploded top front isometric view of wire cap assembly 70. FIG. 19 is an exploded bottom front isometric view of wire cap assembly 70. FIG. 20 is an exploded rear isometric view of wire cap assembly 70. Conductor slots 128 of termination cap 72, align with IDCs 68. Commonly, plug assemblies are limited by the overall diameter of a cable and diameter of individual conductors that they can terminate. Using wire cap assembly 70 and IDCs 68, these ranges can increase. In an embodiment, the approximate range for shielded plug assembly 46 is terminating 22-26 AWG conductors with a max insulation diameter of 0.060", and a cable jacket diameter of 0.200" to 0.330". Wire cap latch 130 of termination cap 72 aligns with pocket 133 of conductive plug body 56 to secure the terminated wire cap assembly 70. Interlocking flanges 132 secure wire cap shield 74 to termination cap 72. Grounding flanges 134 of wire cap shield 74 engage with conductive plug body 56 to complete a path to ground. Grounding fingers 135 of wire cap shield 74 engage with conductive strain relief clip 76 to complete a path to ground. Conductive strain relief clip 76 adheres to termination cap 72 via teeth 136. When conductive strain relief clip 76 ratchets down onto cable 50, it makes mechanical and electrical contact with the shielding of the cable which can be foil, drain wire, braid, or any other. This ratcheting also forces the shielding of cable 50 to make electrical and mechanical contact with grounding seat 137 of wire cap shield 74, thus completing a path to ground. To ensure that when wire cap assembly 70 is inserted into conductive plug body 56 it is aligned when terminating to IDCs 68, relief slot 138 of termination cap 72 and relief slit 140 of wire cap shield 74 align with guide rail 122.

Figure 21:
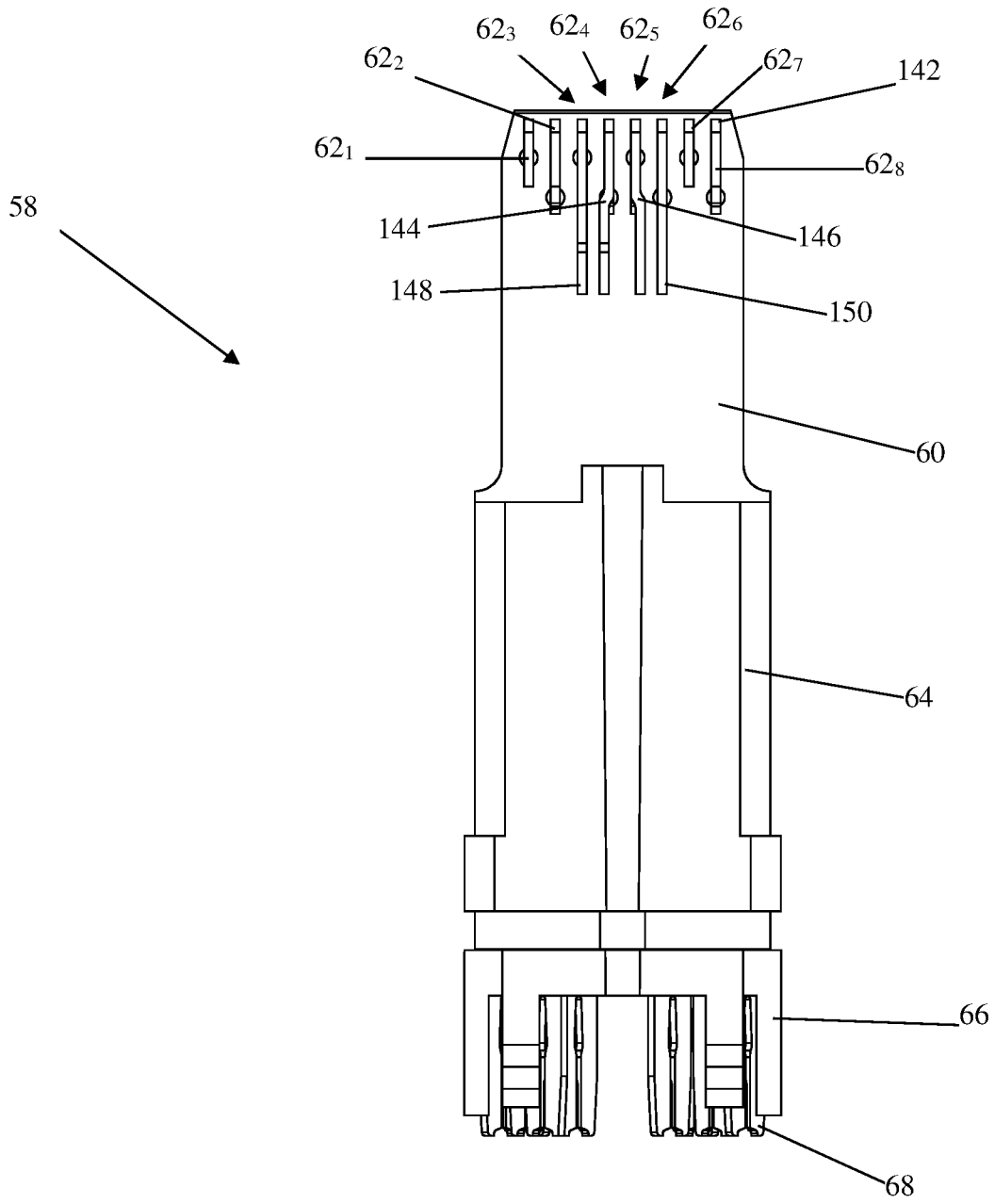
FIG. 21 is a top view of the termination sled shown in FIG. 10, with a detailed view of the region of termination of plug contacts.
Figure 22:
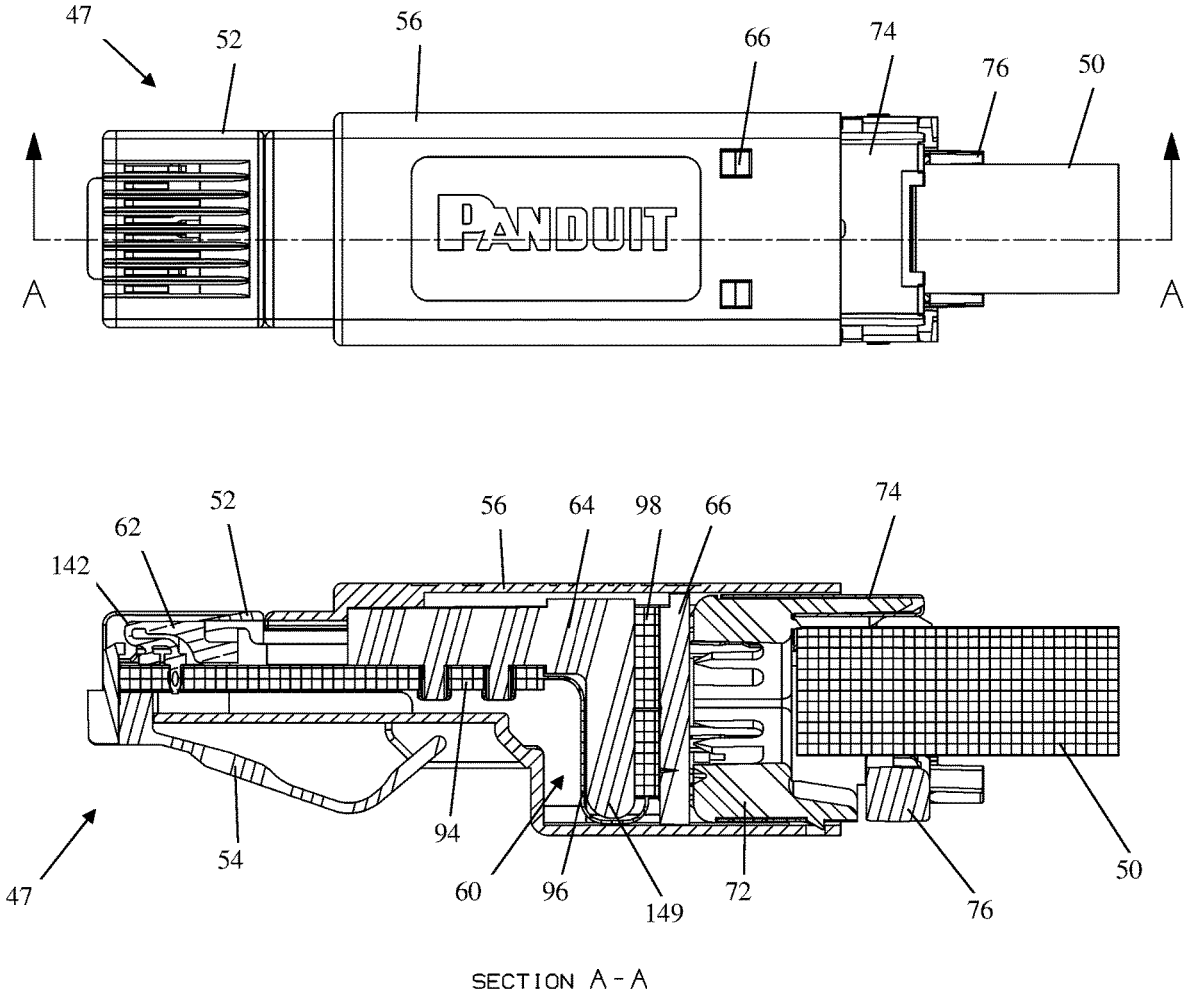
FIG. 22 is a side view of the shielded communications cord shown in FIG. 2, and a section view about section line A-A.

FIG. 21 is a top view of termination sled 58, with a detailed view of the region of termination of plug contacts 62. FIG. 22 is a side view of shielded communications cord 47 and a section view about section line A-A (the termination of the conductors in the assembly is excluded for clarity). The conductors within an RJ45 plug are typically labelled 1-8 in sequential order. The wiring of these cables to RJ45 connectors to make a straight through cable is defined by EIA/TIA 568B. In this cable layout, all pins are wired one-to-one to the other side. Non-adjacent shall henceforth mean any numbered electrical pin that is not within ±1 of a corresponding pin. A non-limiting example would be that pin 3 is non-adjacent to pin 5 but adjacent to pin 4. This is important in that coupling that occurs between conductor 3 and conductor 4 is considered cross-talk (or offending crosstalk) whereas the coupling that occurs between conductor 3 and conductor 5 is considered compensation (or reverse polarity crosstalk, or compensation crosstalk). It should be noted that those of ordinary skill in the art will be readily familiar with the notions of offending crosstalk and compensatory crosstalk within the realm of connectors standardized in part by EIA/TIA 568B. While there is a defined spacing of approximately 0.040" between adjacent plug contacts in the plug jack mating interface, there is no such defined spacing after that interface. In the presently described embodiment, after the plug/jack mating interface 142 (i.e., the portion of the plug contact that contacts a corresponding plug interface contact (PIC) on the mating communications jack), plug contact $\mathbf{62}_4$ jogs over closer to $\mathbf{62}_3$ (the subscript defines the conductor within the plug). This jog over 144 increases the crosstalk between plug contacts $\mathbf{62}_4$ and $\mathbf{62}_3$ over a given electrical length than would have occurred without the jog over. Plug contact $\mathbf{62}_5$ has a similar jog 146 in the opposite direction as jog 144 towards plug contact $\mathbf{62}_6$, and also has a similar effect on plug contacts $\mathbf{62}_5$ and $\mathbf{62}_6$. Both jog 144 and jog 146 occur on an offshoot of the electrical path after plug/jack preferred mating interface 142, thus improving the phase of the plug. Both plug contact $\mathbf{62}_3$ and $\mathbf{62}_4$ have capacitance plates 148 after plug/jack preferred mating interface 142. These capacitance plates 148 are on a different plane than that of the capacitance plates 150 in plug contacts $\mathbf{62}_5$ and $\mathbf{62}_6$. The purpose of having capacitance plates 148 and 150 on different planes is that as these plates get large an impedance mismatch can occur between plug contacts $\mathbf{62}_4$ and $\mathbf{62}_5$ affecting return loss, unless the spacing between the plates is increased. The size of capacitance plates 148 and 150 can be varied based on the amount of crosstalk in the design of the PCB of the plug.

While the shielded plug assembly 46 was disclosed as a shielded solution, it could be used in a UTP solution as well, by replacing all conductive components with non-conductive components (conductive plug body 56 and conductive strain relief clip 76) and excluding wire cap shield 74.

Figure 23:
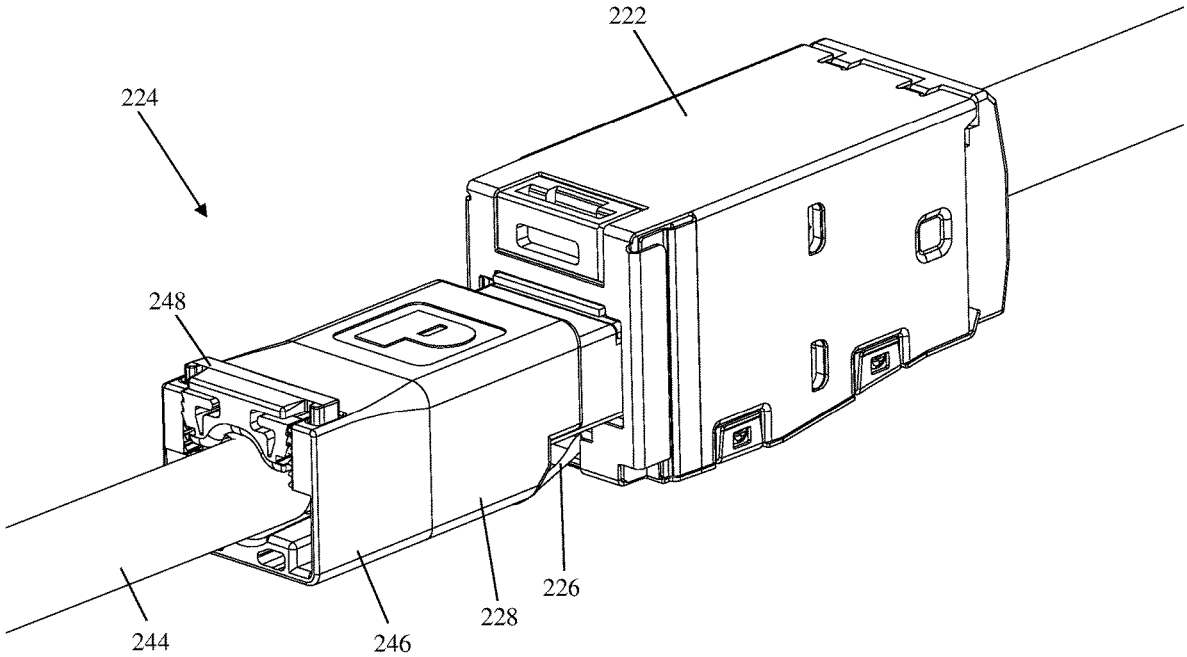
FIG. 23 is another implementation of a shielded communications cord, according to the present disclosure.
Figure 24:
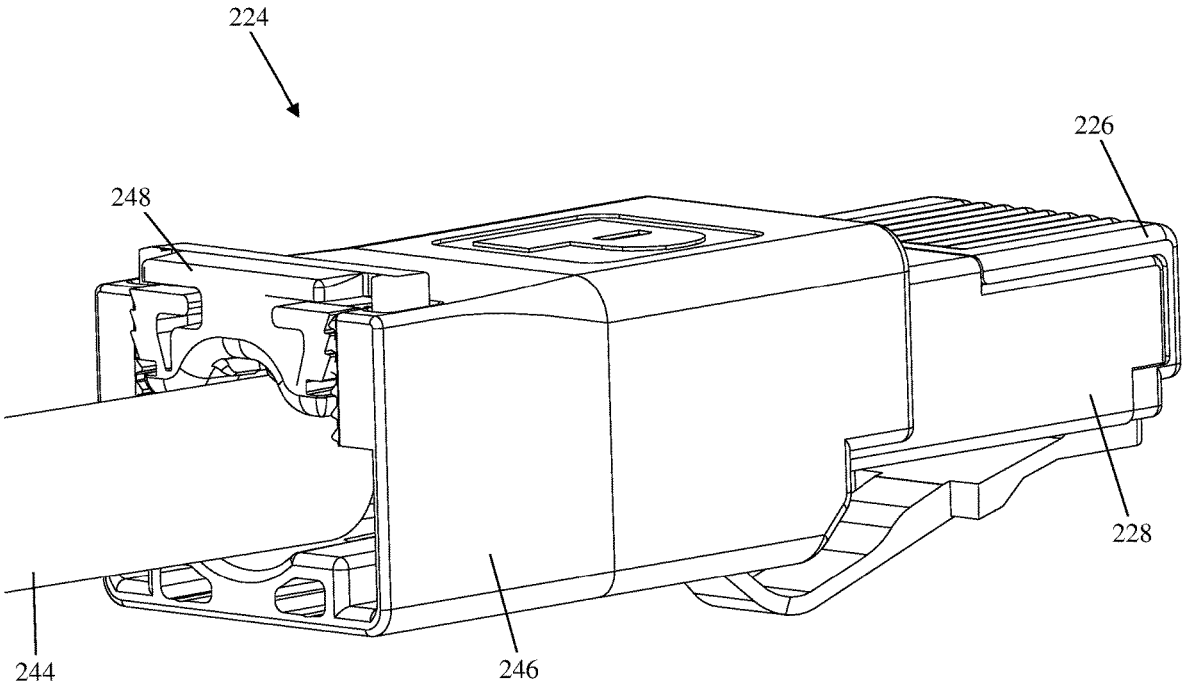
FIG. 24 is a rear top isometric view of the communications cord shown in FIG. 23.
Figure 25:
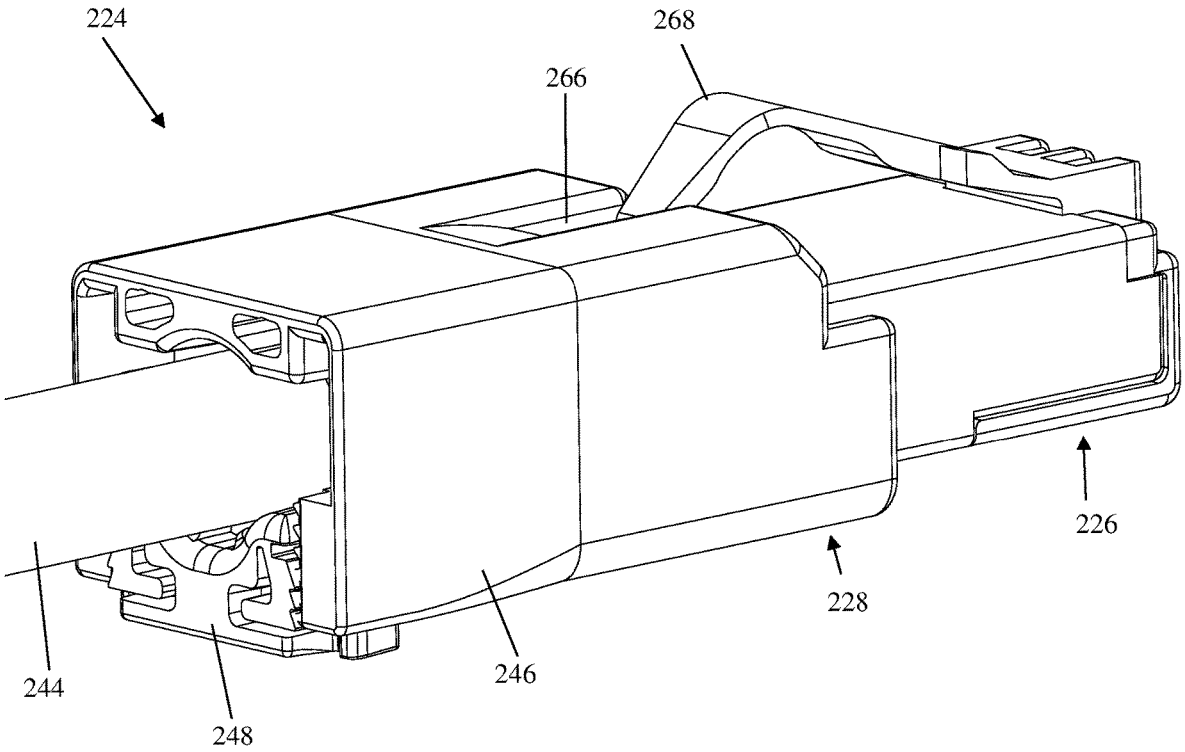
FIG. 25 is a rear bottom isometric view of the communications cord shown in FIG. 23.
Figure 26:
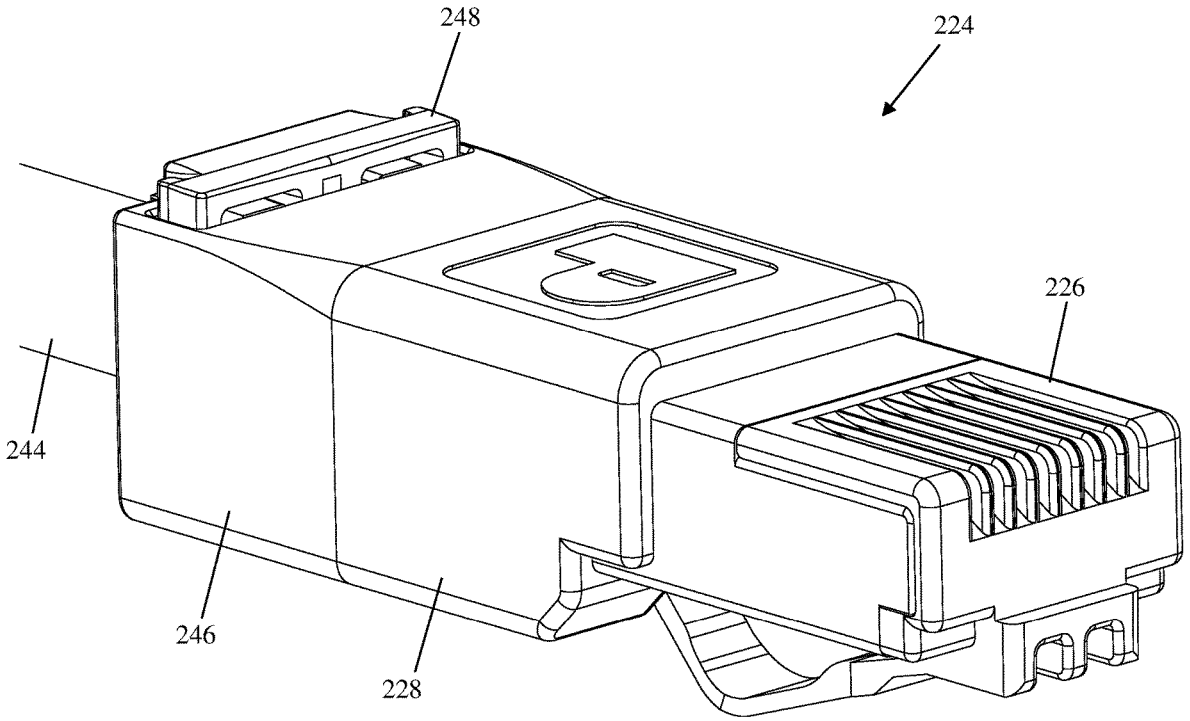
FIG. 26 is a front top isometric view of the communications cord shown in FIG. 23.
Figure 27:
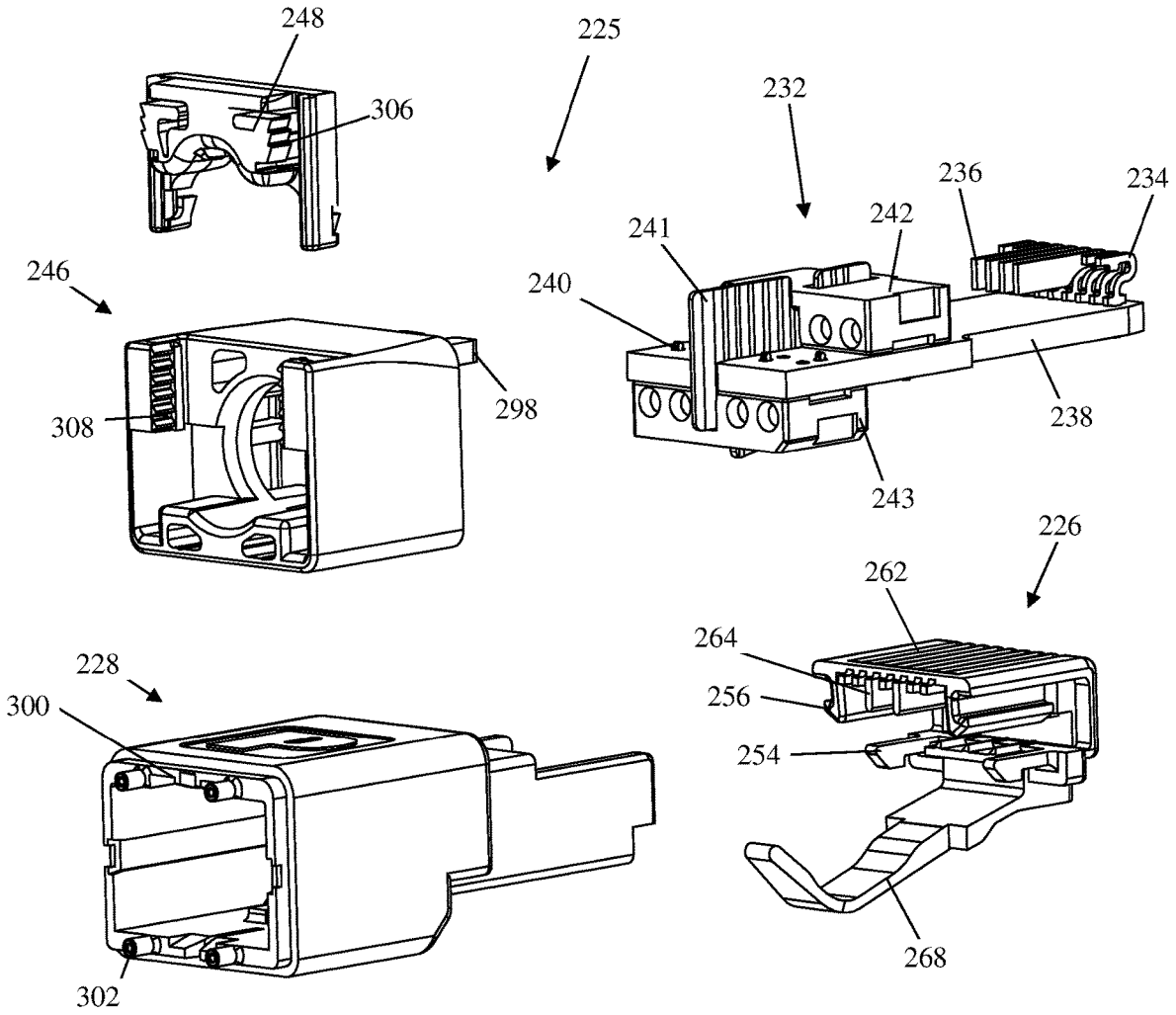
FIG. 27 is an exploded rear top isometric view of a communications plug included in the communications cord shown in FIG. 23.
Figure 28:
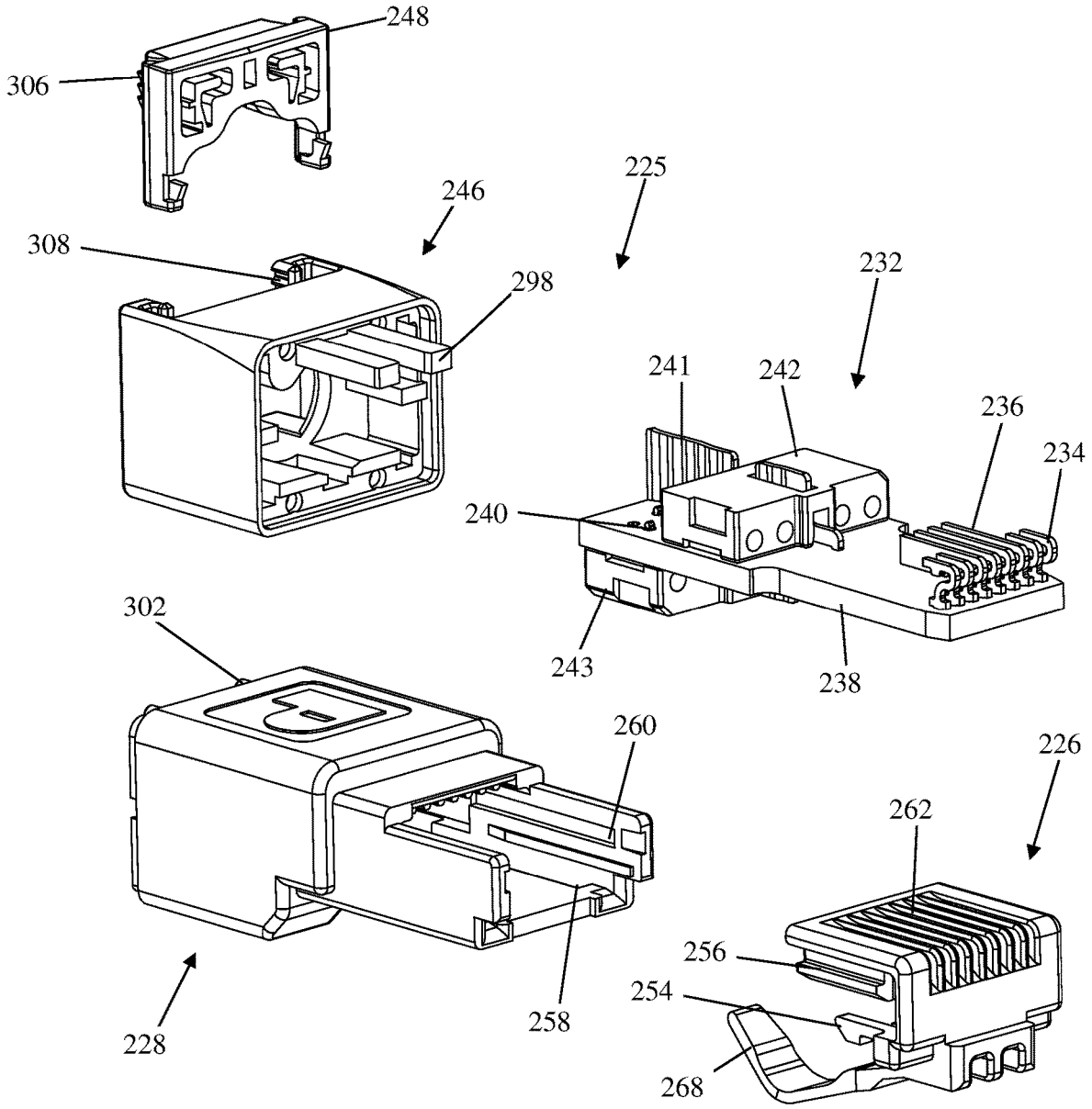
FIG. 28 is an exploded front top isometric view of the communications plug shown in FIG. 27.
Figure 29:
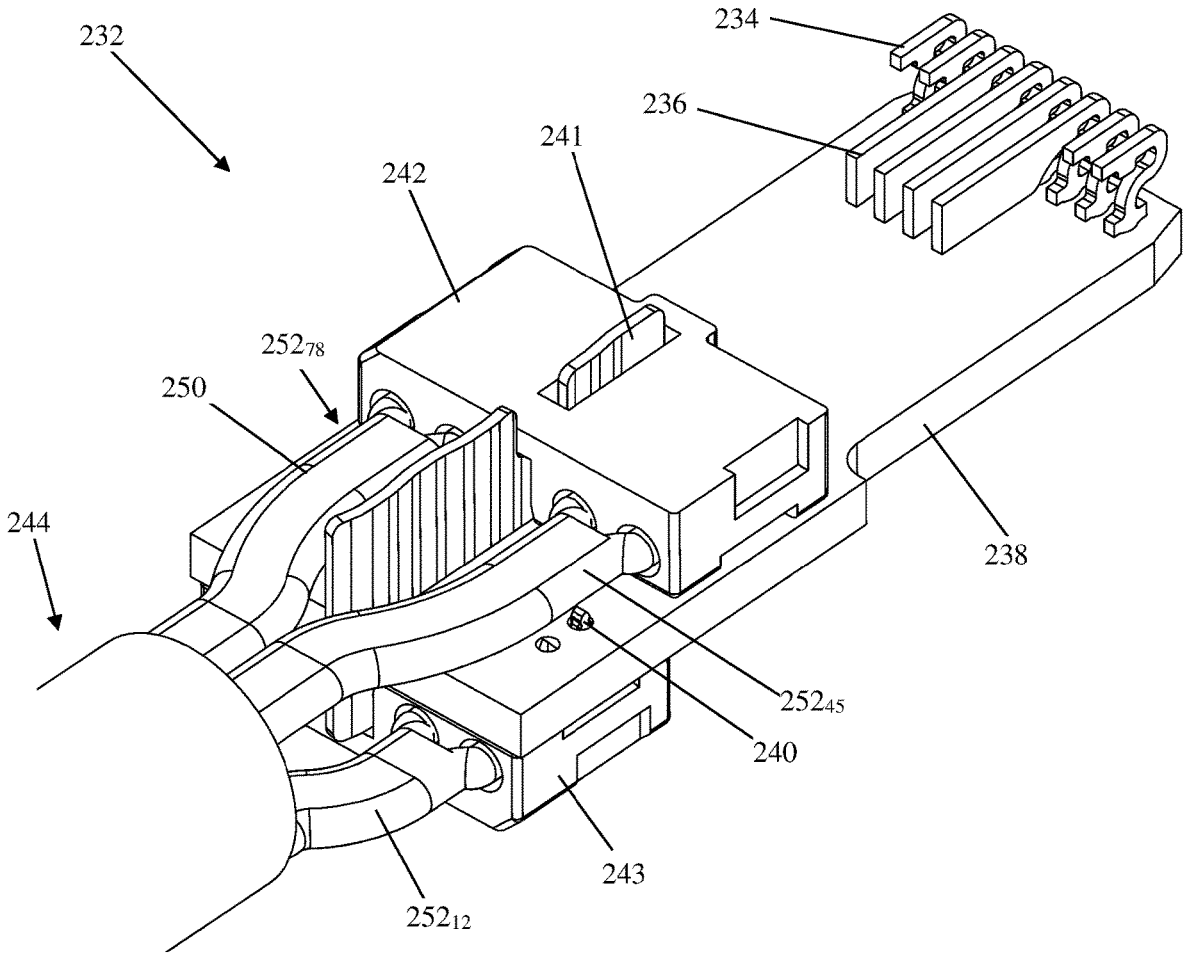
FIG. 29 shows a front top trimetric view of a PCB assembly included in the communications plug shown in FIG. 27.
Figure 30:
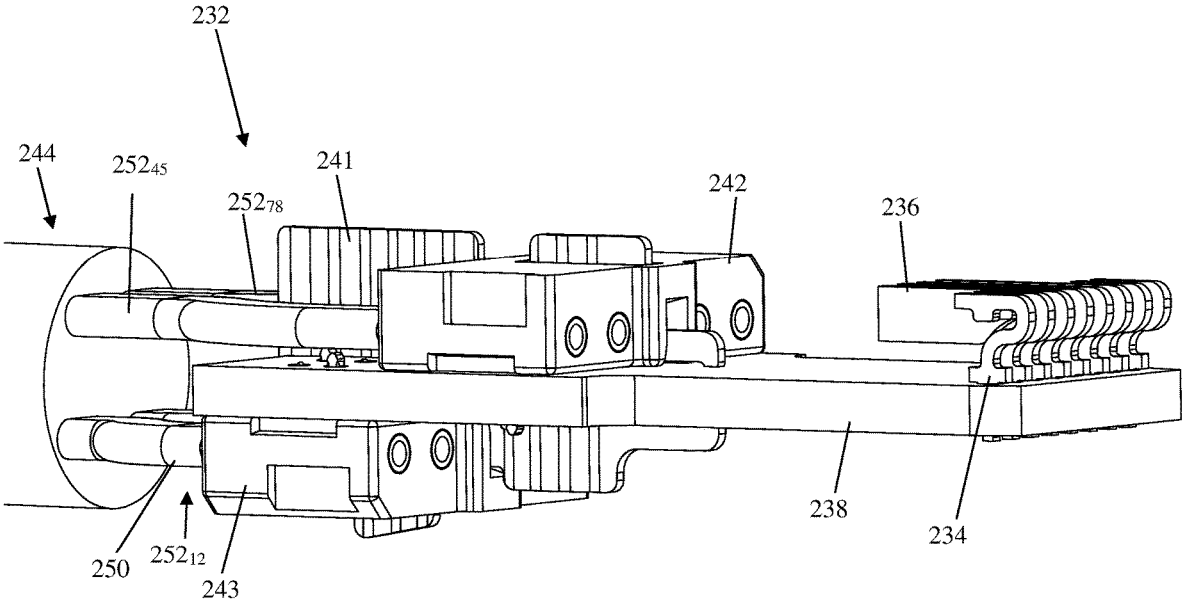
FIG. 30 shows a front isometric view of the PCB assembly shown in FIG. 29.
Figure 31:
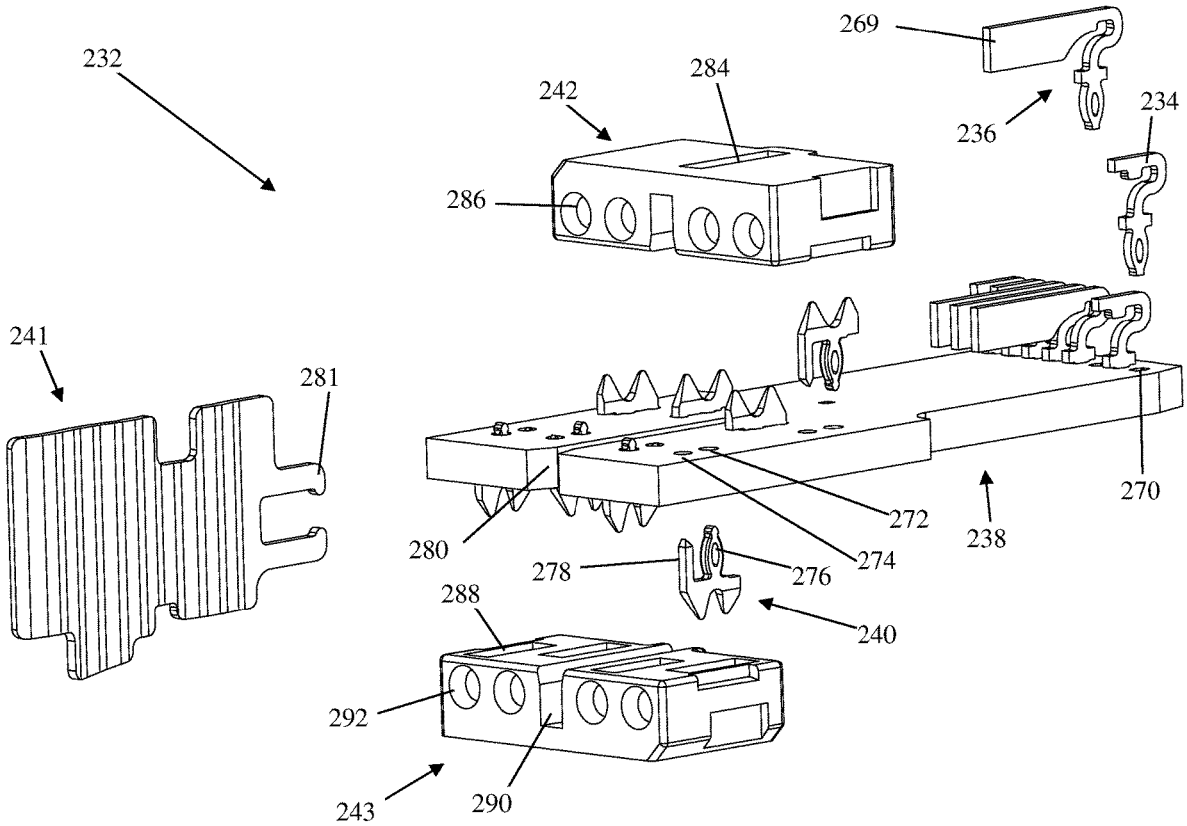
FIG. 31 shows a front top isometric view of the PCB assembly shown in FIG. 29.
Figure 32:
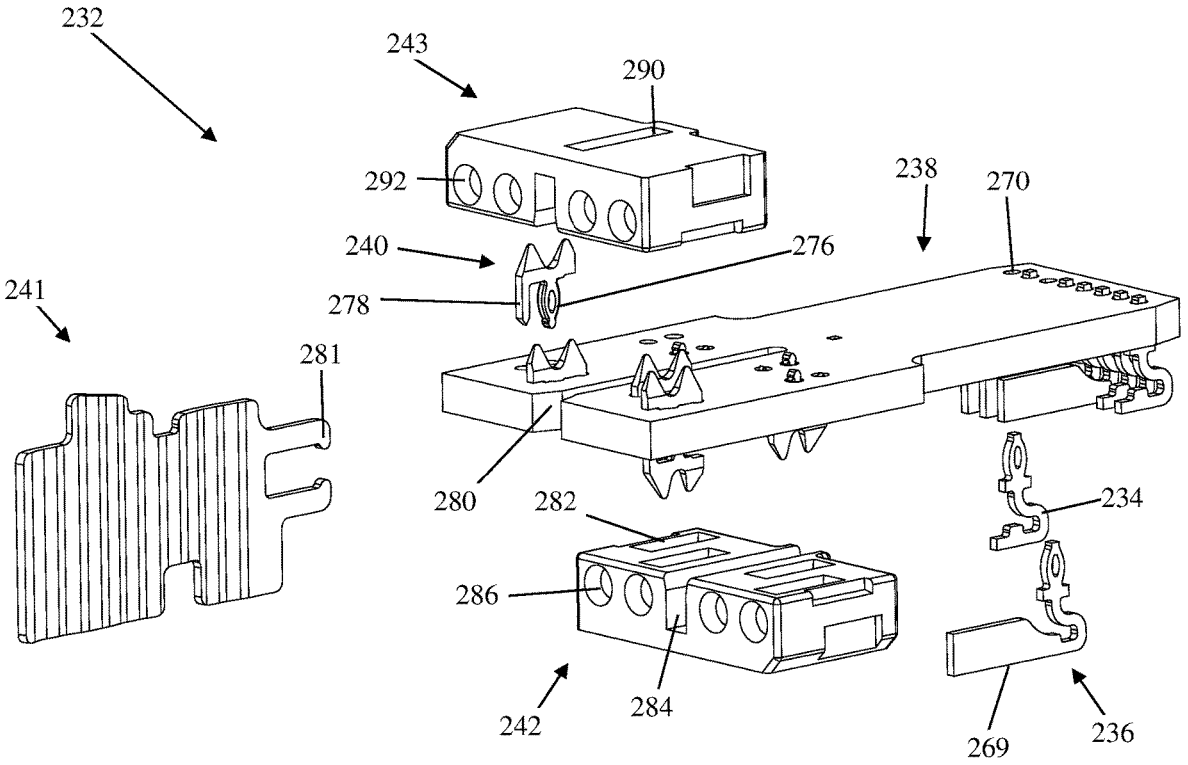
FIG. 32 shows a front bottom isometric view of the PCB assembly shown in FIG. 29.
Figure 33:
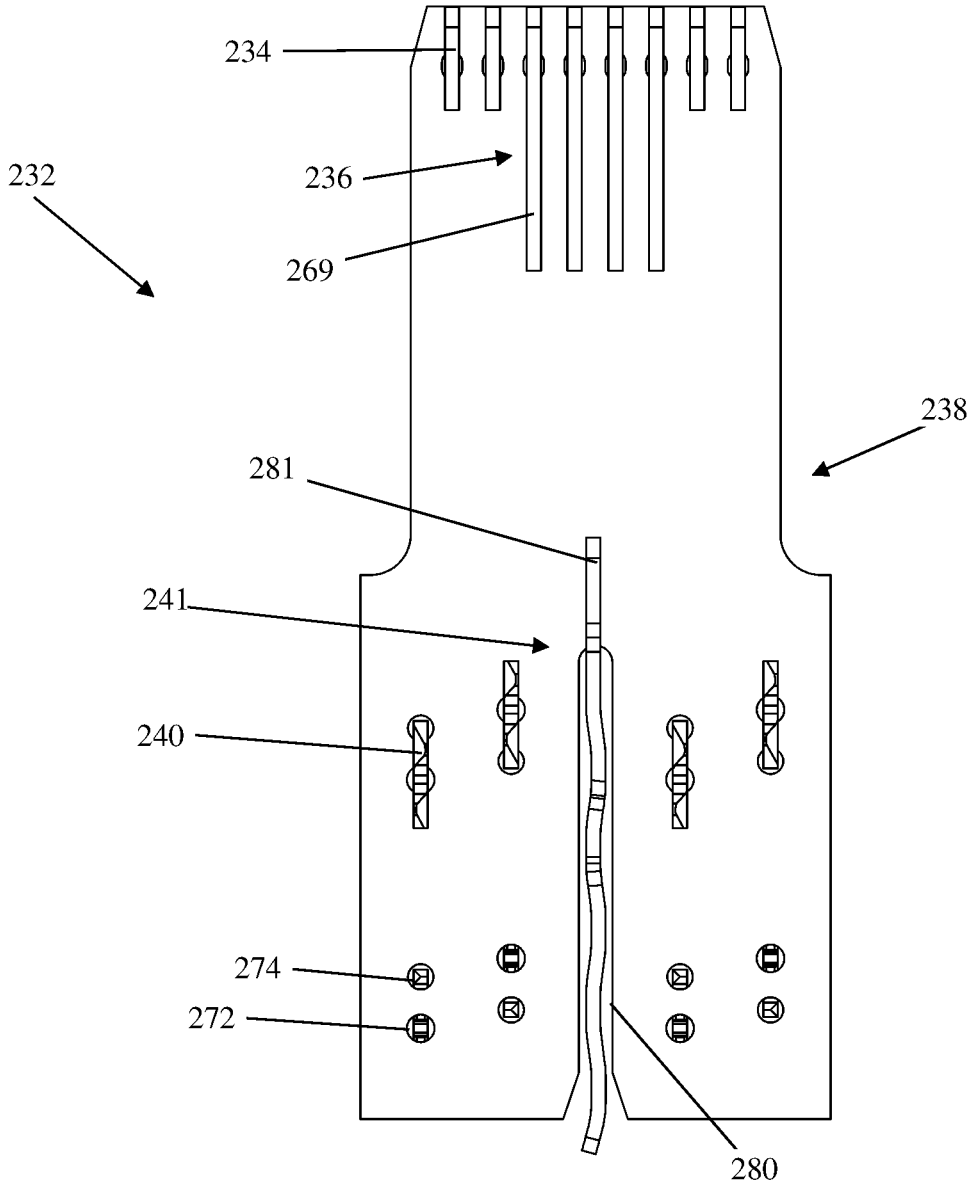
FIG. 33 shows a top view of the PCB assembly shown in FIG. 29.
Figure 34:
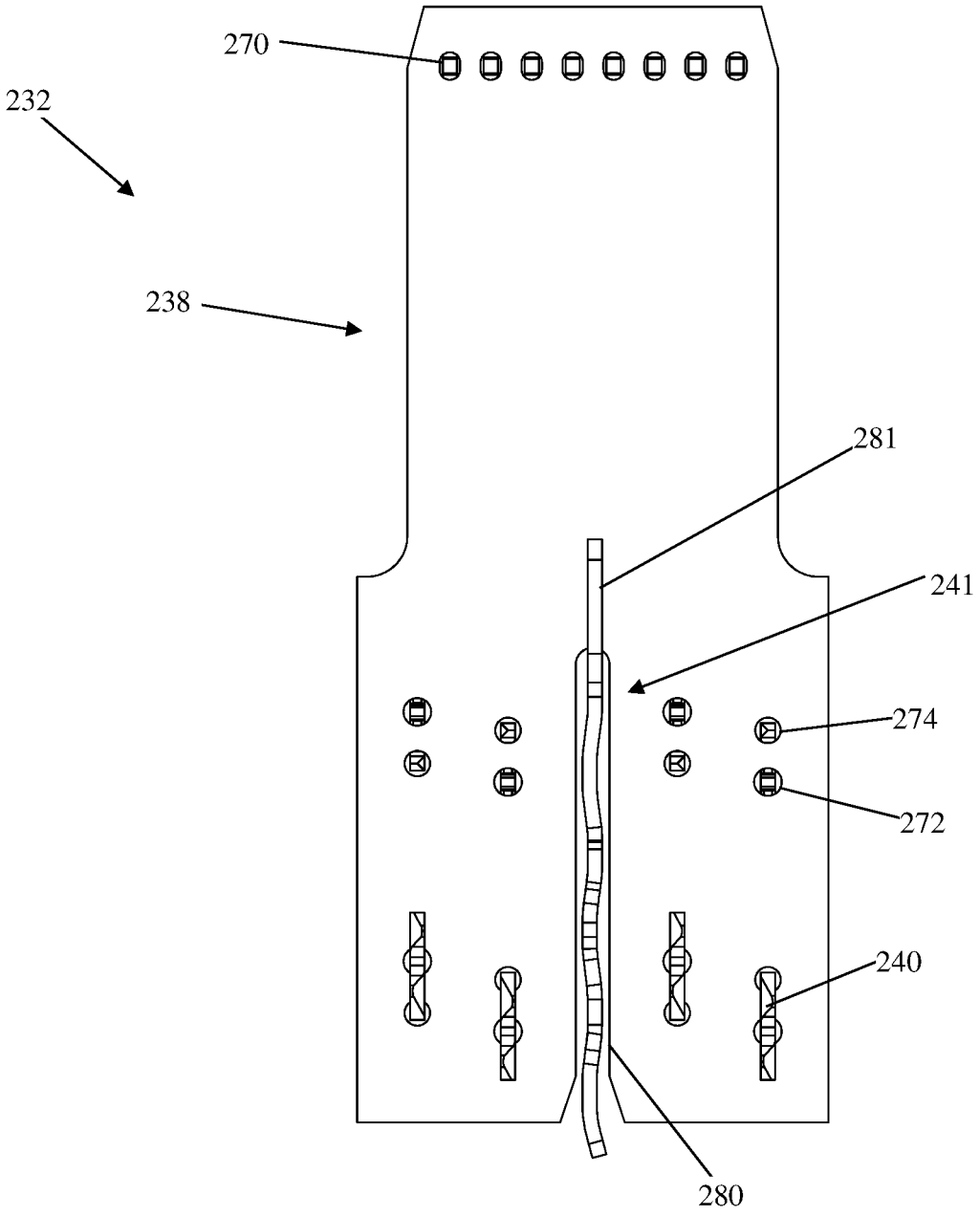
FIG. 34 shows a bottom view of the PCB assembly shown in FIG. 29.

Another embodiment of the present disclosure is shown in FIGS. 23-36. FIG. 23 is an isometric view of a single shielded RJ45 jack 222 with communications cord 224 installed. FIG. 24 is a rear top isometric view of the communications cord 224. FIG. 25 is a rear bottom isometric view of the communications cord 224. FIG. 26 is a front top isometric view of the communications cord 224. FIG. 27 is an exploded rear top isometric view of communications plug 225. FIG. 28 is an exploded front top isometric view of communications plug 225. Communications cord 224 includes plug assembly 225 connected to shielded cable 244. Plug assembly 225 includes front housing 226, conductive shell 228, PCB assembly 232 (which includes plug contacts 234, plug contacts 236, PCB 238, insulation piercing contacts (IPCs) 240, shielded divider 241, front load bar 242, and rear load bar 243), rear conductive shell 246, and conductive strain relief clip 248. FIG. 29 shows a front top trimetric view of PCB assembly 232 with shielded cable 244 installed. FIG. 30 shows a front isometric view PCB assembly 232 with shielded cable 244 installed. FIG. 31 shows a front top isometric view PCB assembly 232, with front load bar 242 and rear load bar 243 exploded. FIG. 32 shows a front bottom isometric view PCB assembly 232, with front load bar 242 and rear load bar 243 exploded. FIG. 33 shows a top view of PCB assembly 232 with front load bar 242 and rear load bar 243 removed for clarity. FIG. 34 shows a bottom view of PCB assembly 232 with front load bar 242 and rear load bar 243 removed for clarity.

During assembly, the first step places rear conductive shell 246 over shielded cable 244. Also, during assembly, front housing 226 attaches to conductive shell 228 through latches 254 and 256, which align with corresponding pockets 258 and 260. Once PCB assembly 232 is installed, latches 254 are trapped from backing out of pocket 258. Front housing 226 has combs 262 which align the contacts within the jack during assembly, specifically between plug contact $\mathbf{236}_3$ and $\mathbf{236}_4$ there is an extended comb 264 as well as an extended comb 264 between plug contact $\mathbf{236}_5$ and $\mathbf{236}_6$ to increase coupling. Relief slot 266 in conductive shell 228, acts as both clearance and an added tangle prevention feature for plug latch 268.

During the assembly process of PCB assembly 232, plug contacts 234 and 236 are placed into vias 270. Plug contacts 236 have capacitive flags 269 which act to reduce the phase of communications cord 224, specifically on wire pairs 3,6 and 4,5. Plug contacts 234 and 236 are shown with compliant pin connections but other non-limiting means such as soldering may be used for electrical and mechanical interfacing with PCB 238. In an embodiment, vias 270 are routed such that they are oval. This can increase the spacing between adjacent vias, while still allowing for a reliable compliant pin design. IPCs 40 are placed into vias 272 and un-plated holes 274.

The complaint pin section 276 is pressed into via 272, and the alignment post 278 is placed into un-plated hole 274. This can limit the amount of rotation allowed by IPC 240. Shielded divider 241 slides at least partially into PCB slot 280 perpendicular to PCB 238; shielded divider 241 is secured in the assembly when front load bar 242 and rear load bar 243 are installed. Front load bar 242 and rear load bar 243 may be positioned on opposite sides of PCB 238. Connection arms 281 of shielded divider 241 attach shielded divider 241 to PCB 238 and act as an optional path of connecting an earth ground to PCB 238. Front load bar 242 has IPC slots 282 which act for clearance of IPCs 240. Front load bar 242 has divider slot 284 which acts as clearance for shielded divider 241. Front load bar 242 has conductor apertures 286 which provide alignment for the conductors of shielded cable 244. Rear load bar 243 has IPC slots 288 which act for clearance of IPCs 240. Rear load bar 243 has divider slot 290 which acts as clearance for shielded divider 241. Rear load bar 243 has conductor apertures 292 which provide alignment for the conductors of shielded cable 244.

When the cable is dressed as shown in FIGS. 29 and 30, each conductor pair is positioned in separate electrically isolated quadrants. This isolation is achieved through three approaches. The first approach is individually wrapping the conductor pairs in shielded cable 244 in a foil 250. Foil 250 isolates coupling between the conductor pairs terminated in front load bar 242 and the conductor pairs terminated in rear load bar 243. Specifically, conductor pairs $252_{12}$ and $252_{36}$ terminate in rear load bar 243 under conductor pairs $252_{45}$ and $252_{78}$, and since conductor pairs $252_{12}$ and $252_{36}$ are no longer in foil 250 when in rear load bar 243, there is a risk of coupling between conductor pairs $252_{12}$, $252_{36}$ and conductor pairs $252_{45}$, $252_{78}$ in this section because conductor pairs conductor pairs $252_{45}$, $252_{78}$ travel over conductor pairs $252_{12}$, $252_{36}$ when they are not in foil 250. However, since conductor pairs $252_{45}$, $252_{78}$ are still in foil 250 in this section, coupling as a result of the termination of conductor pairs $252_{12}$, $252_{36}$ in rear load bar 243 is mitigated.

The second approach is via isolation with shielded divider 241 which mitigates coupling of adjacent pairs (e.g., adjacent conductor pairs $252_{45}$ and $252_{78}$, or conductor pairs $252_{12}$ and $252_{36}$), specifically when no longer in foil 250.

The third means of isolation is front to back separation of the front load bar 242 and rear load bar 243 such that no conductor pair 252 that is not in foil 250 runs on top of each other over PCB 238. In other words, rear load bar 243 is positioned closer to a rear edge of PCB 238 than front load bar 242. Moreover, rear load bar 243 and front load bar 242 are positioned such that there is no overlap between them.

To insulate foil 250 from IPCs 240 and PCB 238, a polyimide film like Kapton may be placed over PCB 238 or the exposed areas of foil 250 may be covered with a non-conductive material such as but not limited to heat shrink or tape. Note that all conductor pairs are interchangeable, in that it is not limiting within the scope of the disclosure to change the wire mapping of IPC 240 positions.

Figure 35:
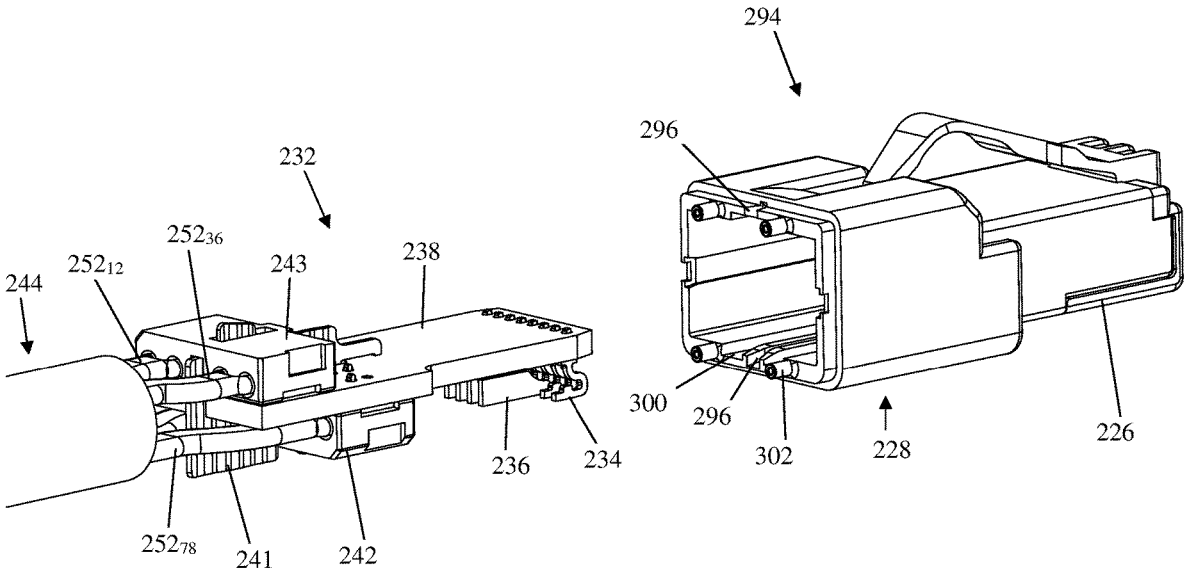
FIG. 35 is a rear bottom isometric view of a front assembly included in the communications plug shown in FIG. 27, along with the PCB assembly shown in FIG. 29.

FIG. 35 shows a rear bottom isometric view of front assembly 294 (which includes front housing 226 and conductive shell 228), and PCB assembly 232 with shielded cable 244 installed prior to insertion. Divider slot 296 of conductive shell 228 acts as a touch off points shielded divider 241. The waviness of shielded divider 241 may force more contact points between conductive shell 228 and shielded divider 241 when shielded divider 241 inherently flattens out as the more contact points there are in general the better the connection to ground. Once PCB assembly 232 is inserted into front assembly 294, rear conductive shell 246 is moved to mate with conductive shell 228. The alignment of rear conductive shell 246 and conductive shell 228 is ensured by the alignment of posts 298 of rear conductive shell 246 and alignment slots 300 of conductive shell 228.

Figure 36:
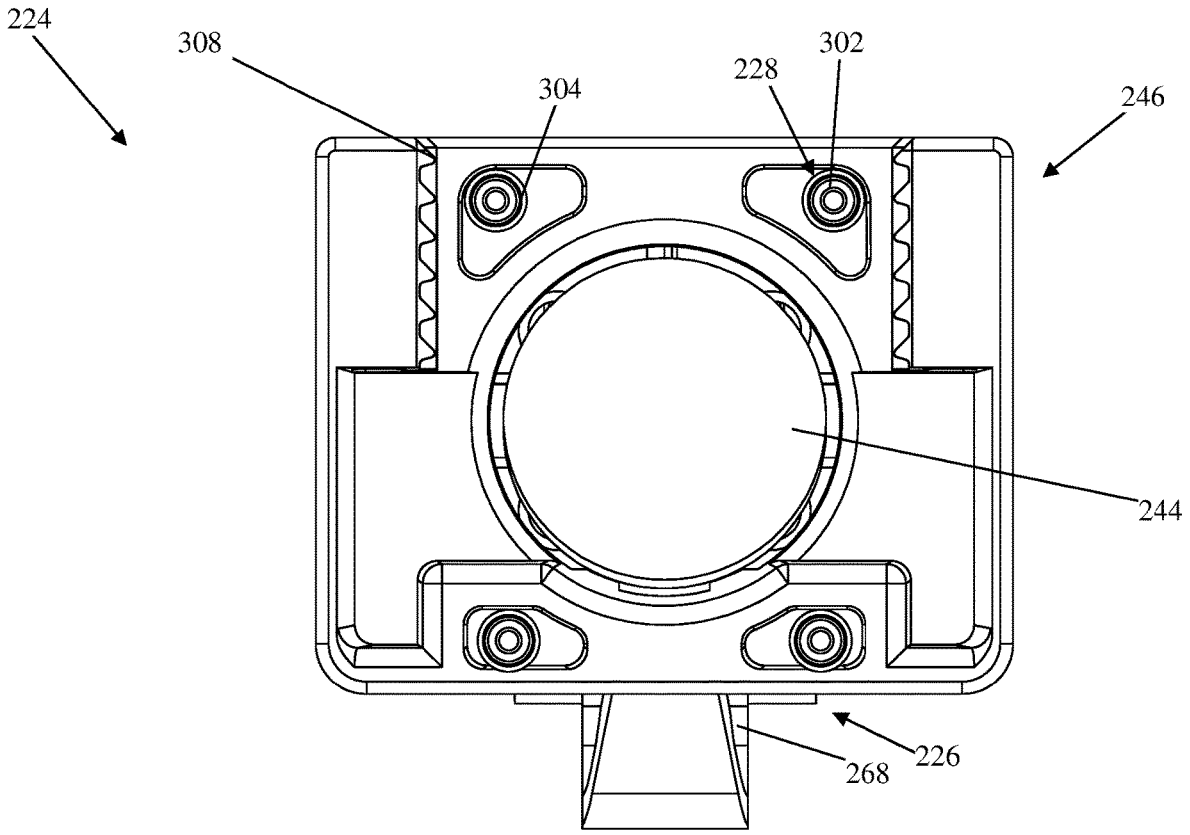
FIG. 36 is a rear view of the communications cord shown in FIG. 23, prior to insertion of a conductive strain relief clip.

FIG. 36 is a rear view of communications cord 224, prior to insertion of conductive strain relief clip 248. Posts 298 serve a double purpose in that they support front load bar 242 from backing out during final assembly. Staking posts 302 of conductive shell 228 are smashed in the final assembly and align with pockets 304 to secure conductive shell 228 to rear conductive shell 246. After securing conductive shell 228 to rear conductive shell 246 conductive strain relief clip 248 can be inserted and pressed onto shielded cable 244 acting as strain relief and ensuring the coupling between the shield of shielded cable 244 and rear conductive shell 246. Ratcheting teeth 306 of conductive strain relief clip 248 align with locking teeth 308 of rear conductive shell 246, too lock the two components together and serve as coupling between the shield of shielded cable 244 and conductive strain relief clip 248.

Figure 37:
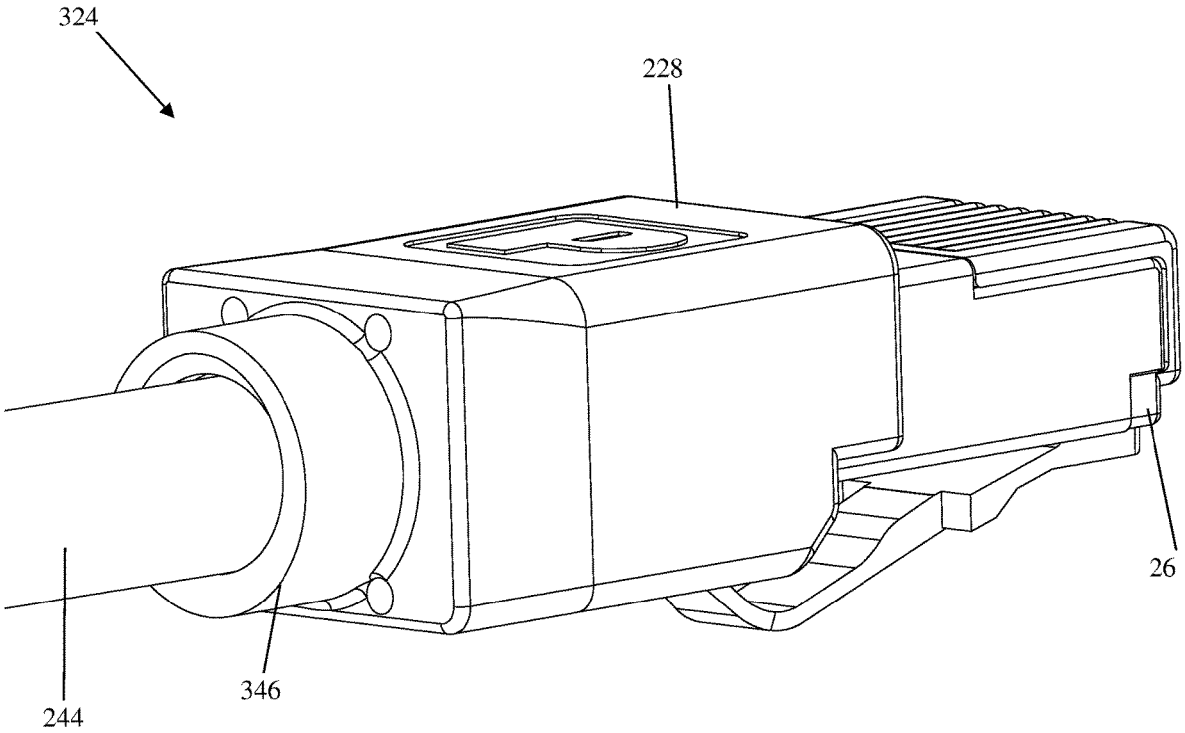
FIG. 37 is a rear isometric view of another implementation of a communications cord.
Figure 38:
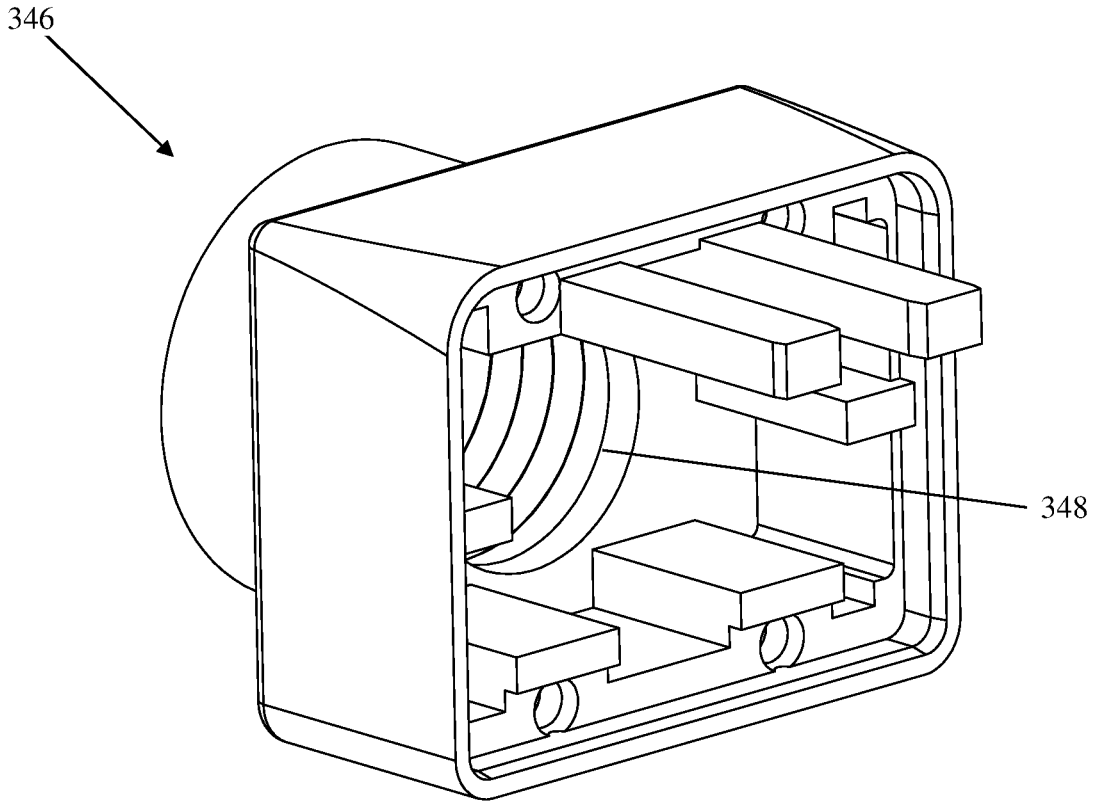
FIG. 38 is a front isometric view of a threaded rear shell included in the communications cord shown in FIG. 37.

While in the above embodiment the communications cord 224 is shown using rear conductive shell 246 and conductive strain relief clip 248, in an alternate embodiment the means of providing both connection to ground and strain relief is provided through a threaded collar. FIG. 37 is a rear isometric view of communications cord 324, which includes all of the same components as communications cord 224, except rear conductive shell 246 and conductive strain relief clip 248 are replaced with the threaded rear shell 346. FIG. 38 is a front isometric view of the threaded rear shell 346 which has thread 348 to connect to the shield of shielded cable 244.

Figure 39:
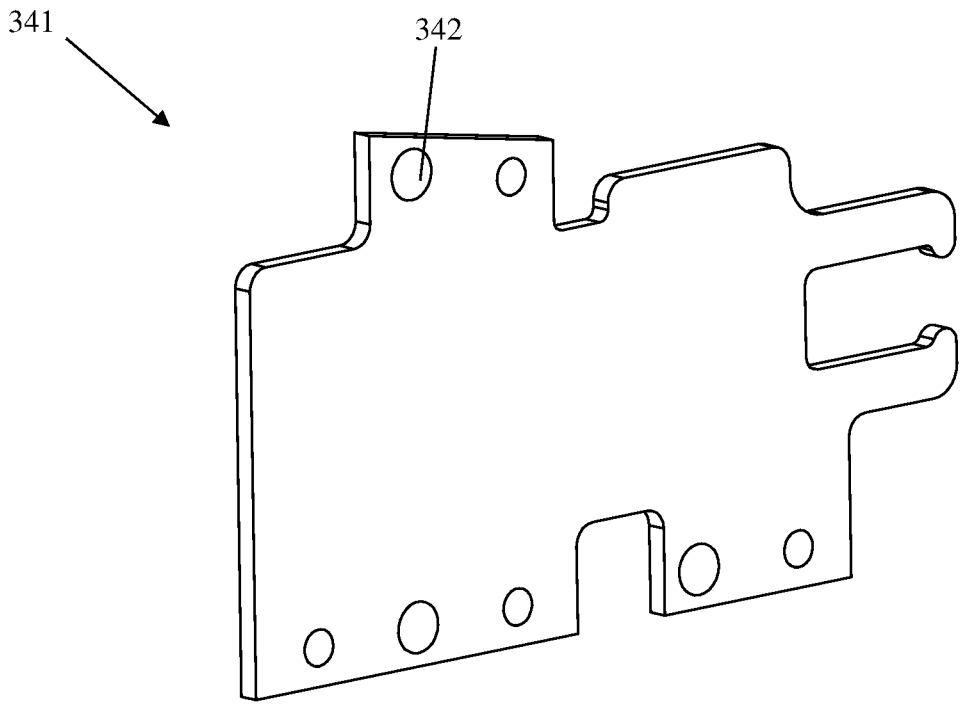
FIG. 39 is a front isometric view of a shielded divider included in the communications cord shown in FIG. 37.
Figure 40:
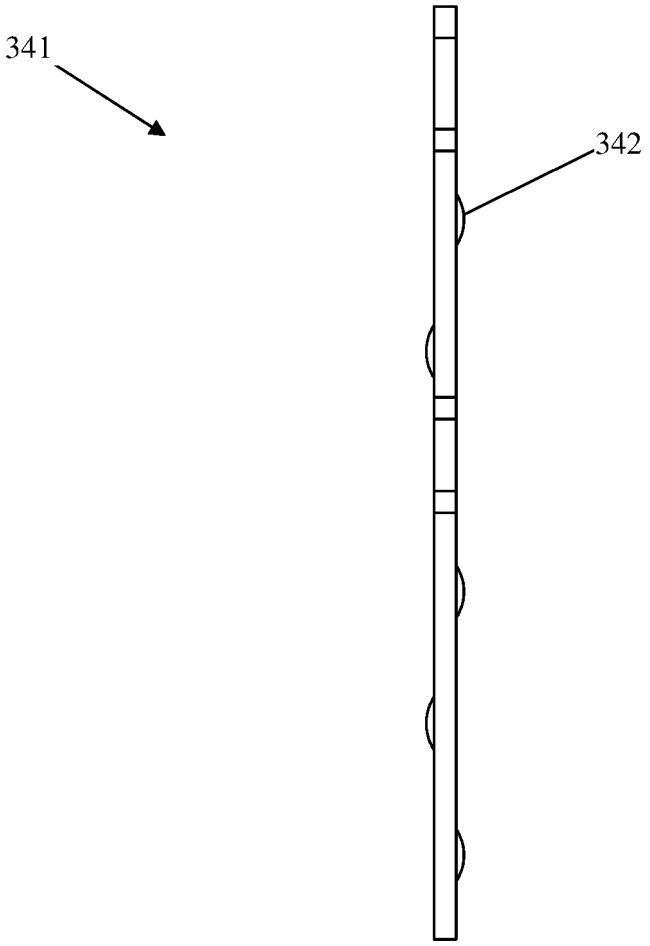
FIG. 40 is a top view of the shielded divider shown in FIG. 39.

While the shielded divider 241 is shown as wavy, the same or similar means of connection can be achieved through other non-limiting means. FIG. 39 is a front isometric view of shielded divider 341 and FIG. 40 is a top view of shielded divider 341. Shielded divider 341 uses bosses 342 to act as connection points, but this can also be done with cutouts or even juts a nominal press fit into the slot relying on tight tolerances.

Note that while the present disclosure illustrates several embodiments, these embodiments are non-limiting (regardless of whether they have been labeled as exemplary or not), and there are alterations, permutations, and equivalents, which fall within the scope of this disclosure. Additionally, the described embodiments should not be interpreted as mutually exclusive, and should instead be understood as potentially combinable if such combinations are permissive. It should also be noted that there are many alternative ways of implementing the methods and apparatuses of the present disclosure. It is therefore intended that claims that may follow be interpreted as including all such alterations, permutations, and equivalents as fall within the true spirit and scope of the present invention.

The invention claimed is:

1. A communications plug, comprising:
- a plug body; and
- a termination sled positioned at least partially in the plug body, the termination sled comprising:
  - a printed circuit board (PCB) having a front section, a rear section, and a connecting section connecting the front section to the rear section; and
  - a plurality of plug contacts secured within the front section, a first and a second plug contact of the plurality of plug contacts having:
    - a mating section at a first end of the plug contact to mate with a corresponding plug interface contact of a mating communications jack;
    - a capacitance plate at a second end of the plug contact; and a jog between the mating section and the capacitance plate.

2. The communications plug of claim 1, wherein:

the PCB is a rigid-flex PCB;

the front section is a front rigid section;

the rear section is a rear rigid section; and the connecting section is a connecting flexible section.

3. The communications plug of claim 2, wherein:

the jog on the first plug contact is in a direction opposite of a direction of the jog on the second plug contact; and the capacitance plate of the first lug contact is on a different plane than the capacitance plate of the second plug contact, causing an impedance mismatch between the first plug contact and the second plug contact.

4. The communications plug of claim 2, a third and a fourth plug contact of the plurality of plug contacts having:

a mating section at a first end of the plug contact to mate with a corresponding plug interface contact of a mating communications jack; and a capacitance plate at a second end of the plug contact.

5. The communications plug of claim 4, wherein:

the third plug contact is positioned adjacent to the first plug contact on the front rigid section of the rigid-flex PCB; and the fourth plug contact is positioned adjacent to the second plug contact on the front rigid section of the rigid-flex PCB.

6. The communications plug of claim 5, wherein:

the jog on the first plug contact is toward the third plug contact; and the jog on the second plug contact is toward the fourth plug contact.

7. The communications plug of claim 5, wherein:

the capacitance plate of the third plug contact is on a same plane as the capacitance plate of the first plug contact; and the capacitance plate of the fourth plug contact is on a same plane as the capacitance plate of the second plug contact.

* * * * *